US009174466B2

(12) United States Patent
Sugimura

(10) Patent No.: US 9,174,466 B2
(45) Date of Patent: Nov. 3, 2015

(54) PRINTER AND NON-TRANSITORY COMPUTER-READABLE MEDIUM

(71) Applicant: BROTHER KOGYO KABUSHIKI KAISHA, Nagoya, Aichi-ken (JP)

(72) Inventor: Yoshihiko Sugimura, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 83 days.

(21) Appl. No.: 13/776,840

(22) Filed: Feb. 26, 2013

(65) Prior Publication Data

US 2013/0223911 A1 Aug. 29, 2013

(30) Foreign Application Priority Data

Feb. 29, 2012 (JP) ..... 2012-043685
Jan. 24, 2013 (JP) ..... 2013-011084

(51) Int. Cl.
*B41J 29/38* (2006.01)
*B41J 13/00* (2006.01)
*B41J 11/42* (2006.01)

(52) U.S. Cl.
CPC ..... *B41J 13/0009* (2013.01); *B41J 11/425* (2013.01)

(58) Field of Classification Search
CPC ..... B41J 29/38; B41J 13/0009; B41J 11/425
USPC ..... 400/583.4
See application file for complete search history.

(56) References Cited

U.S. PATENT DOCUMENTS 5,177,422 A * 1/1993 Kataoka et al. ..... 318/696
5,204,692 A * 4/1993 Awai et al. ..... 347/180
6,502,913 B2 * 1/2003 Ho et al. ..... 347/9
6,503,006 B1 1/2003 Freedman et al.
6,607,321 B2 * 8/2003 Markham ..... 400/582
6,680,785 B1 1/2004 Nibe et al.
8,035,672 B2 * 10/2011 Matsuda ..... 347/188

(Continued)

FOREIGN PATENT DOCUMENTS

CN 101602291 12/2009
JP 62167062 A * 7/1987 ..... B41J 29/38

(Continued)

OTHER PUBLICATIONS

Extended European Search Report issued in Application No. 13156108.6 on Jul. 18, 2013.

(Continued)

*Primary Examiner* — Nguyen Ha
(74) *Attorney, Agent, or Firm* — McCarter & English, LLP

(57) ABSTRACT

A printer includes a feeding portion configured to feed a printing medium, a printing portion including a plurality of heating elements configured to perform printing of one line at a time on the printing medium, and a processor configured to specify numbers of ON dots for at least a first specified block and a second specified block, specify first speeds that respectively correspond to at least the first specified block and the second specified block based on the numbers of ON dots, set a second speed for the second specified block based on the first speeds that respectively correspond to the first specified block and the second specified block, such that the printing medium is fed at the first speed for the first specified block when the printing of the first specified block is performed, and control the feeding portion and the printing portion.

12 Claims, 23 Drawing Sheets

(56) References Cited

U.S. PATENT DOCUMENTS

| | | | | |
|---|---|---|---|---|
| 2005/0219345 | A1 | 10/2005 | Muto et al. | |
| 2007/0267996 | A1 * | 11/2007 | Shibasaki et al. | 318/696 |
| 2009/0309945 | A1 * | 12/2009 | Matsuda | 347/180 |

FOREIGN PATENT DOCUMENTS

| | | | | |
|---|---|---|---|---|
| JP | H5-261959 | | 10/1993 | |
| JP | H8-11341 | | 1/1996 | |
| JP | 2000343742 | | 12/2000 | |
| JP | 2001-180027 | | 7/2001 | |
| JP | 2005-186509 | | 7/2005 | |
| JP | 2005-280221 | | 10/2005 | |
| JP | 2009-297998 | | 12/2009 | |
| JP | 2009298037 | A * | 12/2009 | B41J 29/38 |

OTHER PUBLICATIONS

Chinese Office Action issued in Application No. 201310054375.1 on Aug. 4, 2014.

* cited by examiner

FIG. 5

131

| DIFFERENCE | 0 | 1 | 2 | 3 | 4 | 5 | 6 | 7 | 8 | 9 |
|---|---|---|---|---|---|---|---|---|---|---|
| SPEED REVISION | 0 | 0 | +1 | +2 | +3 | +4 | +5 | +6 | +7 | +8 |

FIG. 6

73

| START LINE | 18 | 19 | 20 | 21 | 22 | 23 | 24 | 25 | 26 | 27 | 28 | 29 | 30 | 31 | 32 | 33 | 34 | 35 | |
|---|---|---|---|---|---|---|---|---|---|---|---|---|---|---|---|---|---|---|---|
| 18 | 8 | 8 | 8 | 8 | 8 | 8 | 8 | 8 | 8 | 8 | | | | | | | | | |
| 19 | | 8 | 8 | 8 | 8 | 8 | 8 | 8 | 8 | 8 | 4 | | | | | | | | ←4+8≧8 (DIFFERENCE : 9) |
| 20 | | | 8 | 8 | 8 | 8 | 8 | 8 | 8 | 8 | 4 | 8 | | | | | | | ←4+7≧8 (DIFFERENCE : 8) |
| 21 | | | | 8 | 8 | 8 | 8 | 8 | 8 | 8 | 4 | 8 | 8 | | | | | | ←4+6≧8 (DIFFERENCE : 7) |
| 22 | | | | | 8 | 8 | 8 | 8 | 8 | 8 | 4 | 8 | 8 | 8 | | | | | ←4+5≧8 (DIFFERENCE : 6) |
| 23 | | | | | | 8 | 8 | 8 | 8 | 8 | 4 | 8 | 8 | 8 | 8 | | | | ←4+4=8 (DIFFERENCE : 5) |
| 24 | | | | | | | 8 | 8 | 8 | 8 | 4 | 8 | 8 | 8 | 8 | 8 | | | ←4+3=7 (DIFFERENCE : 4) |
| 25 | | | | | | | | 8 | 8 | 8 | 4 | 8 | 8 | 8 | 8 | 8 | 8 | | ←4+2=6 (DIFFERENCE : 3) |
| 26 | | | | | | | | | 8 | 8 | 4 | 8 | 8 | 8 | 8 | 8 | 8 | 8 | ←4+1=5 (DIFFERENCE : 2) |
| 27 | | | | | | | | | | 8 | 4 | 8 | 8 | 8 | 8 | 8 | 8 | 8 | ←4+0=4 (DIFFERENCE : 1) |
| 28 | | | | | | | | | | | 4 | 8 | 8 | 8 | 8 | 8 | 8 | 8 | ←4+0=4 (DIFFERENCE : 0) |

FIG. 9

132

| | | PREVIOUS FEED SPEED | | | | | | | | |
|---|---|---|---|---|---|---|---|---|---|---|
| | | 0 | 1 | 2 | 3 | 4 | 5 | 6 | 7 | 8 |
| SUBSEQUENT FEED SPEED | 0 | 0 | 0 | 1 | 2 | 3 | 4 | 5 | 6 | 7 |
| | 1 | 1 | 1 | 1 | 2 | 3 | 4 | 5 | 6 | 7 |
| | 2 | 1 | 2 | 2 | 2 | 3 | 4 | 5 | 6 | 7 |
| | 3 | 1 | 2 | 3 | 3 | 3 | 4 | 5 | 6 | 7 |
| | 4 | 1 | 2 | 3 | 4 | 4 | 4 | 5 | 6 | 7 |
| | 5 | 1 | 2 | 3 | 4 | 5 | 5 | 5 | 6 | 7 |
| | 6 | 1 | 2 | 3 | 4 | 5 | 6 | 6 | 6 | 7 |
| | 7 | 1 | 2 | 3 | 4 | 5 | 6 | 7 | 7 | 7 |
| | 8 | 1 | 2 | 3 | 4 | 5 | 6 | 7 | 8 | 8 |

FIG. 10

121

| LINE | 18 | 19 | 20 | 21 | 22 | 23 | 24 | 25 | 26 | 27 | 28 |
|---|---|---|---|---|---|---|---|---|---|---|---|
| SECOND SPEED | 8 | 8 | 8 | 8 | 8 | 8 | 7 | 6 | 5 | 4 | 4 |

FIG. 15

121

| LINE | 28 | 29 | 30 | 31 | 32 | 33 | 34 | 35 | 36 | 37 | 38 | 39 | 40 | 41 | 42 | 43 | 44 | 45 |
|---|---|---|---|---|---|---|---|---|---|---|---|---|---|---|---|---|---|---|
| SECOND SPEED | 4 | 5 | 6 | 7 | 8 | 8 | 8 | 8 | 7 | 6 | 5 | 4 | 3 | 2 | 1 | 0 | 0 | 1 |

FIG. 19

76

| START BLOCK | 17 | 18 | 19 | 20 | 21 | 22 | 23 | 24 | 25 | 26 | 27 | 28 | 29 | 30 | 31 | 32 | 33 | 34 | 35 | 36 | 37 | 38 | 39 | 40 | 41 | 42 | 43 | 44 |
|---|---|---|---|---|---|---|---|---|---|---|---|---|---|---|---|---|---|---|---|---|---|---|---|---|---|---|---|---|
| 17, 18 | 8 | | 8 | | 8 | | 8 | | 8 | | 4 | | 8 | | 8 | | 8 | | 8 | | | | | | | | | |
| 19, 20 | | | 8 | | 8 | | 8 | | 8 | | 4 | | 8 | | 8 | | 8 | | 8 | | 8 | | | | | | | |
| 21, 22 | | | | | 8 | | 8 | | 8 | | 4 | | 8 | | 8 | | 8 | | 8 | | 8 | | 8 | | | | | |
| 23, 24 | | | | | | | 8 | | 8 | | 4 | | 8 | | 8 | | 8 | | 8 | | 8 | | 8 | | 8 | | | |
| 25, 26 | | | | | | | | | 8 | | 4 | | 8 | | 8 | | 8 | | 8 | | 8 | | 8 | | 8 | | 0 | |
| 27, 28 | | | | | | | | | | | 4 | | 8 | | 8 | | 8 | | 8 | | 8 | | 8 | | 8 | | 0 | |
| 29, 30 | | | | | | | | | | | | | 8 | | 8 | | 8 | | 8 | | 8 | | 8 | | 8 | | 0 | |
| 31, 32 | | | | | | | | | | | | | | | 8 | | 8 | | 8 | | 8 | | 8 | | 8 | | 0 | |

FIG. 20

76

| START BLOCK | 17 | 18 | 19 | 20 | 21 | 22 | 23 | 24 | 25 | 26 | 27 | 28 | 29 | 30 | 31 | 32 | 33 | 34 | 35 | 36 | 37 | 38 | 39 | 40 | 41 | 42 | 43 | 44 |
|---|---|---|---|---|---|---|---|---|---|---|---|---|---|---|---|---|---|---|---|---|---|---|---|---|---|---|---|---|
| 17, 18 | 8 | | 8 | | 8 | | 8 | | 8 | | 8 | | 8 | | 8 | | 8 | | 8 | | | | | | | | | |
| 19, 20 | | | 8 | | 8 | | 8 | | 8 | | 7 | | 8 | | 8 | | 8 | | 8 | | 8 | | | | | | | |
| 21, 22 | | | | | 8 | | 8 | | 8 | | 6 | | 8 | | 8 | | 8 | | 8 | | 8 | | 8 | | | | | |
| 23, 24 | | | | | | | 8 | | 8 | | 5 | | 8 | | 8 | | 8 | | 8 | | 8 | | 8 | | 8 | | | |
| 25, 26 | | | | | | | | | 8 | | 4 | | 8 | | 8 | | 8 | | 8 | | 8 | | 8 | | 8 | | 8 | |
| 27, 28 | | | | | | | | | | | 4 | | 8 | | 8 | | 8 | | 8 | | 8 | | 8 | | 8 | | 7 | |
| 29, 30 | | | | | | | | | | | | | 8 | | 8 | | 8 | | 8 | | 8 | | 8 | | 8 | | 6 | |
| 31, 32 | | | | | | | | | | | | | | | 8 | | 8 | | 8 | | 8 | | 8 | | 8 | | 5 | |

FIG. 21

121

| BLOCK | 17, 18 | 19, 20 | 21, 22 | 23, 24 | 25, 26 | 27, 28 | 29, 30 | 31, 32 | 33, 34 | 35, 36 |
|---|---|---|---|---|---|---|---|---|---|---|
| SECOND SPEED | 8 | 7 | 6 | 5 | 4 | 4 | 5 | 5 | 4 | 3 |

PRINTER AND NON-TRANSITORY COMPUTER-READABLE MEDIUM

CROSS-REFERENCE TO RELATED APPLICATION

This application claims priority to Japanese Patent Application No. 2012-043685 filed on Feb. 29, 2012, and also claims priority to Japanese Patent Application No. 2013-011084 filed on Jan. 24, 2013. The disclosure of the foregoing applications is herein incorporated by reference in its entirety.

BACKGROUND

The present disclosure relates to a printer that is configured to perform printing on a printing medium by using heat and to a non-transitory computer-readable medium.

A printer is known that performs printing on a printing medium using a thermal line head that includes a plurality of heating elements. The heating elements for a single line of an image that will be formed are arrayed in a main scanning direction on the thermal line head. The printer may operate the thermal line head by applying an electric current to the heating elements, causing the heating elements to generate heat.

A method has been proposed for limiting the electric power that is consumed when the thermal line head is operated. For example, a method is disclosed for detecting a number of ON dots in printing data for one line and controlling the number of the heating elements that are heated based on the number of the detected ON dots. An outline of the method will be explained. The plurality of the heating elements that are provided in the thermal line head are divided into a plurality of blocks. In a case where the number of the detected ON dots is low, the printer heats the heating elements in all of the blocks at the same time. In this case, the printing of the entire line will be performed all at once, so the time that will be required in order to print the line may be short. Therefore, the printer can feed the printing medium at high speed, so can perform high-speed printing.

On the other hand, in a case where the number of the detected ON dots is large, the printer heats the heating elements at a different time for each block. In this case, the printing of the line will be performed by being divided into a plurality of rounds, so the time that will be required in order to print the line will become longer than in the case described above, where the printing of the entire line is performed all at once. Therefore, the printer cannot feed the printing medium at high speed. Accordingly, the printing medium is fed at low speed. As described above, the printer performs printing on the printing medium while switching the feed speed of the printing medium in accordance with the number of the detected ON dots.

SUMMARY

In some cases, time may be required in order to switch the feed speed of the printing medium. Specifically, the printer may feed the printing medium by using a feed roller that is rotated by the operation of a motor. The printer of this type is not able to change the revolution speed of the motor rapidly, so time is required in order for the motor to switch to the specified revolution speed. In that case, it may take too much time before the feed roller is rotated at the revolution speed that corresponds to the detected number of the ON dots. Accordingly, the time that is required to complete the printing may become longer.

Various embodiments of the general principles described herein provide a printer and a non-transitory computer-readable medium that each enable printing on a printing medium with a thermal line head in a short time.

Various embodiments herein provide a printer that includes a feeding portion, a printing portion, and a processor. The feeding portion is configured to feed a printing medium in an auxiliary scanning direction. The printing portion includes a plurality of heating elements arrayed in a main scanning direction. The main scanning direction is orthogonal to the auxiliary scanning direction. The plurality of heating elements are configured to perform printing of one line at a time on the printing medium fed in the auxiliary scanning direction by the feeding portion, the one line extending in the main scanning direction. The processor is configured to specify numbers of ON dots for at least a first specified block and a second specified block among a plurality of lines that make up a printed pattern. The first specified block is one of a plurality of blocks. Each of the plurality of blocks includes a first specified number of lines. The second specified block is another of the plurality of blocks and includes a line to be printed before the first specified block. The number of ON dots is a number of heating elements, among the plurality of heating elements, to be operated when the printing of one line is performed. The processor is also configured to specify first speeds that respectively correspond to at least the first specified block and the second specified block based on the numbers of ON dots. The processor is further configured to set a second speed based on the first speeds that respectively correspond to the first specified block and the second specified block, such that the printing medium is fed by the feeding portion at the first speed for the first specified block when the printing of the first specified block is performed by the printing portion. The second speed is a feed speed of the printing medium fed by the feeding portion when the printing of the second specified block is performed by the printing portion. The processor is further configured to control the feeding portion and the printing portion such that the printing medium is fed by the feeding portion at the second speed when the printing of the second specified block is performed by the printing portion.

Various embodiments also provide a non-transitory computer-readable medium storing computer-readable instructions. When executed by a processor of a printer, the computer-readable instructions cause the printer to perform a step of specifying numbers of ON dots for at least a first specified block and a second specified block among a plurality of lines that make up a printed pattern. The first specified block is one of a plurality of blocks. Each of the plurality of blocks includes a first specified number of lines. The second specified block is another of the plurality of blocks and includes a line to be printed before the first specified block. The number of ON dots is a number of heating elements, among a plurality of heating elements of the printer, to be operated when the printing of one line is performed. The computer-readable instructions also cause the printer to perform a step of specifying first speeds that respectively correspond to at least the first specified block and the second specified block based on the numbers of ON dots. The computer-readable instructions further cause the printer to perform a step of setting a second speed based on the first speeds that respectively correspond to the first specified block and the second specified block, such that a printing medium is fed by a feeding portion at the first speed for the first specified block when the printing of the first specified block is performed by a printing portion. The second speed is a feed speed of the printing medium fed by the feeding portion when the printing of the second specified block is performed by the printing portion. The feeding portion is configured to feed the printing medium in an auxiliary scanning direction. The printing portion includes the plurality of heating elements arrayed in a main scanning direction and configured to perform printing of one line at a time on the printing medium fed in the auxiliary scanning direction by the feeding portion. The one line extends in the main scanning direction. The main scanning direction is orthogonal to the auxiliary scanning direction. The computer-readable instructions further cause the printer to perform a step of controlling the feeding portion and the printing portion such that the printing medium is fed by the feeding portion at the second speed when the printing of the second specified block is performed by the printing portion.

BRIEF DESCRIPTION OF THE DRAWINGS

Embodiments will be described below in detail with reference to the accompanying drawings in which:

FIG. 5 is a figure that shows a first table 131.

FIG. 6 is an explanatory figure that shows a method of revising the first speeds of the first example.

FIG. 9 is a figure that shows a second table 132.

FIG. 10 is a figure that shows a third table 121.

FIG. 15 is another figure that shows the third table 121.

FIG. 19 is a figure that shows first feed speeds that correspond to blocks in the other embodiment.

FIG. 20 is an explanatory figure that shows a method of setting second speeds based on the first speeds that have been revised in the other embodiment.

FIG. 21 is a figure that shows the third table 121 of the other embodiment.

DETAILED DESCRIPTION OF EMBODIMENTS

Figure 1:
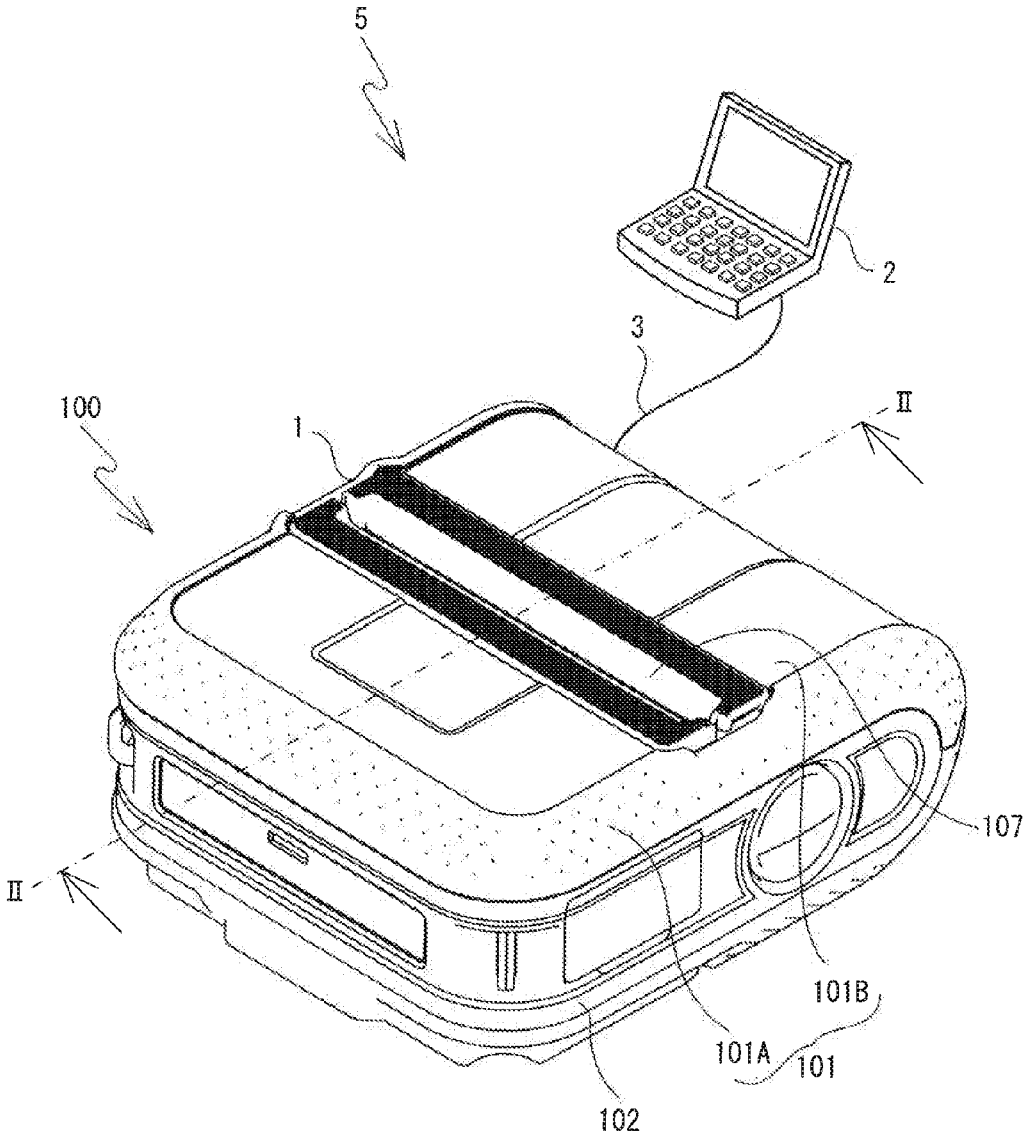
FIG. 1 is a figure that shows an overview of a printing system 5.

Hereinafter, embodiments will be explained with reference to the drawings.

An overview of a printing system 5 will be explained with reference to FIG. 1. The printing system 5 includes a printer 1 and an external terminal 2. The printer 1 and the external terminal 2 can be connected to one another by a USB cable 3. The printer 1 is configured to print text characters, graphics, and the like on a heat-sensitive tape 8 that is a printing medium (refer to FIG. 4 and the like). After the printing, a user may create a label by cutting off the portion of the heat-sensitive tape 8 on which the text characters, graphics, and the like have been printed. The printer 1 may operate based on printing data that have been received from the external terminal 2 and perform the printing. The external terminal 2 may be a general-purpose personal computer, for example. The external terminal 2 may create the printing data that are required when the printer 1 performs printing. The user is able to edit the printing data through a keyboard and a mouse of the external terminal 2.

The configuration of the printer 1 will be explained. The lower right, the upper left, the upper right, the lower left, the upward direction, and the downward direction in FIG. 1 are respectively defined as the right, the left, the rear, the front, the top, and the bottom of the printer 1.

Figure 2:
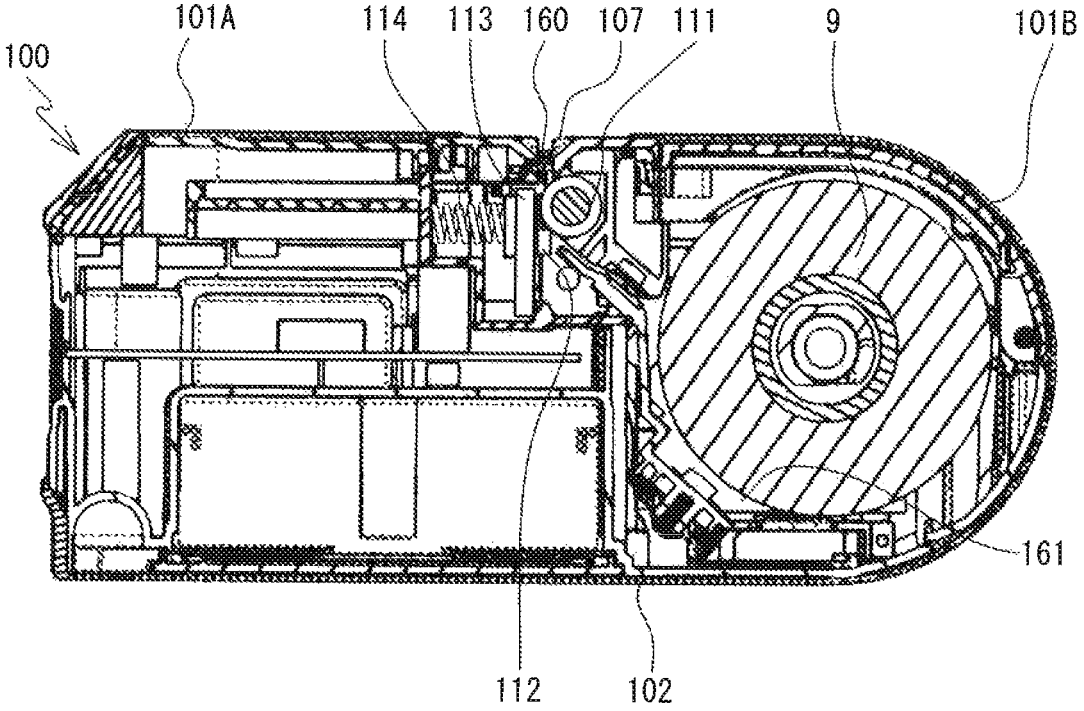
FIG. 2 is a sectional view as seen in the direction the arrows on a line II-II in FIG. 1.

As shown in FIG. 1, the printer 1 includes a housing 100. The housing 100 includes a top cover 101 and a bottom cover 102. The top cover 101 includes a fixed portion 101A and a lid 101B. As shown in FIG. 2, the printer 1 includes a roll containing portion 161 that is provided underneath the lid 101B. A roll 9, around which the heat-sensitive tape 8 is wound, may be mounted in the roll containing portion 161. With the lid 101B in the open state, the user is able to mount and replace the roll 9 easily.

A discharge outlet 107 is provided in the top cover 101 (refer to FIG. 1) between the fixed portion 101A and the lid 101B. The portion of the heat-sensitive tape 8 on which the printing has been performed may be discharged from the inside to the outside of the housing 100 through the discharge outlet 107. The printer 1 includes a platen roller 111 that is rotatably supported below the front edge of the lid 101B. The printer 1 includes a drive motor 18 (refer to FIG. 3) inside the housing 100. CPU 11 (refer to FIG. 3) may control the operation of the drive motor 18. The drive motor 18 may rotationally drive the platen roller 111.

The printer 1 includes a thermal line head 112, a fixing plate 113, and a spring 114 below the rear end portion of the fixed portion 101A. The fixing plate 113 is provided in front of the platen roller 111. The thermal line head 112 is fixed on the rear face of the fixing plate 113. The thermal line head 112 has a structure in which a plurality of heating elements are arrayed in a single row in the left-right direction. The plurality of the heating elements that are arrayed in the single row correspond to one line in an image that is formed on the heat-sensitive tape 8. Each of the heating elements is configured to generate heat, when an electric current is applied. The spring 114 energizes the fixing plate 113 toward the rear. A cutting blade 160 is provided above the thermal line head 112. The user can cut the heat-sensitive tape 8 manually by pulling the heat-sensitive tape 8 that has been discharged from the discharge outlet 107 toward the front and pressing it against the cutting blade 160.

A process of creating a label will be explained. The heat-sensitive tape 8 that extends from the roll 9 passes between the platen roller 111 and the thermal line head 112. The spring 114 energizes the fixing plate 113 toward the rear, causing the thermal line head 112 to press the heat-sensitive tape 8 against the platen roller 111 with a specified force. In this state, the plurality of the heating elements of the thermal line head 112 are selectively supplied with an electric current and generate heat. Images of pixels are formed on the heat-sensitive tape 8 that correspond to the individual ones of the plurality of the heating elements that have generated heat, such that one line of the image is printed. At the same time with the supplying of the electric current to the heating elements, the platen roller 111 rotates as the drive motor 18 turns. The rotation of the platen roller 111 draws out the heat-sensitive tape 8 from the roll 9. Hereinafter, the left-right direction, which is the direction in which the plurality of the heating elements are lined up in the thermal line head 112, will also be called a main scanning direction. The direction in which the heat-sensitive tape 8 is fed will also be called an auxiliary scanning direction. The main scanning direction and the auxiliary scanning direction are orthogonal to one another.

The printer 1 prints an image of characters and graphics ultimately on the heat-sensitive tape 8 by the forming in the auxiliary scanning direction of a series of images of individual lines that each extend in the main scanning direction. After the printing, the printer 1 discharges the heat-sensitive tape 8 to the outside of the housing 100 from the discharge outlet 107. A user cuts the discharged heat-sensitive tape 8 with the cutting blade 160. The label can be thus created.

Figure 3:
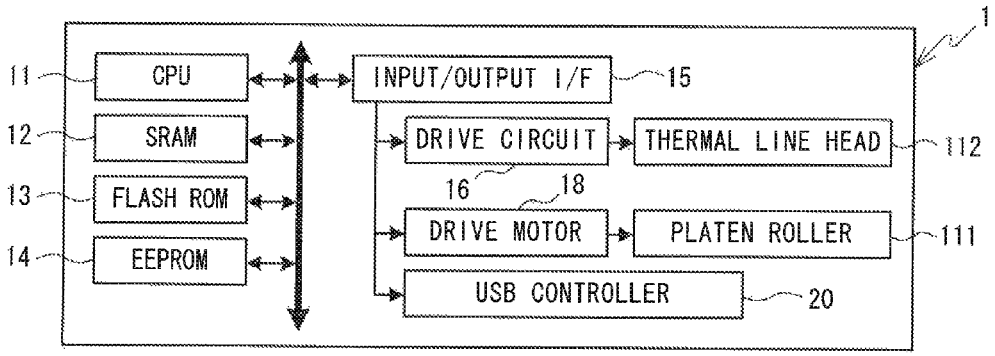
FIG. 3 is a block diagram that shows an electrical configuration of a printer 1.

The electrical configuration of the printer 1 will be explained with reference to FIG. 3. The printer 1 includes the CPU 11, an SRAM 12, a flash ROM 13, an EEPROM 14, an input/output interface (I/F) 15, a drive portion 16, the drive motor 18, the thermal line head 112, the platen roller 111, and a USB controller 20.

The CPU 11 is configured to perform overall control of the printer 1. The flash ROM 13 is a rewriteable non-volatile storage element. A control program, a first table 131 (refer to FIG. 5) and a second table 132 (refer to FIG. 9), which will be described later, and the like may be stored in the flash ROM 13. The printing data that have been received from the external terminal 2, a third table 121 (refer to FIGS. 10, 15 and 21), and the like may be temporarily stored in the SRAM 12. The input/output I/F 15 may transmit data and control signals between the CPU 11 on one side and the drive portion 16, the drive motor 18, and the USB controller 20 on the other side. The drive portion 16 may drive the thermal line head 112 in accordance with the control of the CPU 11. The drive motor 18 may drive the platen roller 111 in accordance with the control of the CPU 11. The USB controller 20 is a device for performing communication with the external terminal 2 through the USB cable 3.

A method for controlling a feed speed of the heat-sensitive tape 8 fed by the platen roller 111 (hereinafter simply called the feed speed) will be explained. The thermal line head 112 is configured to cause the heating elements to generate heat by applying the electric current to the heating elements. Hereinafter, such operation of the thermal line head 112 is called operating the heating elements. As the number of the heating elements that are operated increases, the electric current that is consumed by the entire thermal line head 112 increases. Therefore, the printer 1 may ordinarily restrict the number of the heating elements that can be operated at the same time. The printer 1 may thus hold down the peak value of the electric current that is consumed by the thermal line head 112.

When the printer 1 prints a single line of an image by using the thermal line head 112, the single line may include pixels where dots are formed and pixels where dots are not formed. The number of the heating elements that are operated when a single line is printed (hereinafter called the number of ON dots) varies according to the number of the pixels where dots are formed. In a case where the number of the ON dots is large, the printer 1 does not operate the heating elements all at once. Specifically, the printer 1 divides the heating elements into a plurality of groups and operates the heating elements on a time division basis, operating each of the groups separately in a plurality of rounds. In the case of a line in which the number of the ON dots is large, the number of the groups becomes greater. Therefore, the number of rounds in which the individual groups of the heating elements are operated also becomes greater. Therefore, in the case of a line in which the number of the ON dots is large, the printer 1 requires a longer time in order to complete the printing of the line than in the case of a line in which the number of the ON dots is low.

Therefore, in a case where the printer 1 performs the printing of a line in which the number of the ON dots is large, the printer 1 reduces the revolution speed of the platen roller 111 and makes the feed speed slower. The printer 1 can thus reliably perform the printing of the single line by preventing the heat-sensitive tape 8 from being fed too far before the printing of the single line is completed. In contrast, in a case where the printer 1 performs the printing of a line in which the number of the ON dots is low, the time until the printing of the single line is completed is shorter, so the printer 1 increases the revolution speed of the platen roller 111 and makes the feed speed faster. The printer 1 can thus shorten the time that is required for the printing on the heat-sensitive tape 8 to be completed. In this manner, the printer 1 can optimize the processing for the printing on the heat-sensitive tape 8 by controlling the revolution speed of the platen roller 111 such that the heat-sensitive tape 8 is fed at a feed speed that corresponds to the number of the ON dots.

The platen roller 111 rotates in conjunction with the rotation of the drive motor 18. The time that is required in order to change the revolution speed of the drive motor 18 becomes longer as the amount of the change in the revolution speed becomes greater. Therefore, in a case where it is necessary for the printer 1 to reduce the feed speed rapidly, it takes some time until the drive motor 18 is made to turn at the new revolution speed. Therefore, in a case where the number of the ON dots has decreased abruptly, there is a possibility that the printer 1 will not be able to immediately start feeding the heat-sensitive tape 8 at the feed speed that corresponds to the number of the ON dots.

Accordingly, in the present embodiment, in a case where the printer 1 reduces the feed speed in order to print appropriately a specified line that is one of a plurality of lines that make up a pattern, the printer 1 may control the feed speed such that the speed reduction is completed just before the printing of the specified line is performed. Specifically, the printer 1 may set the feed speed that will be used when a line that is printed before the specified line is printed, then operates the platen roller 111 by controlling the drive motor 18. Thus the printer 1 is able to optimize the conformity of the feed speed to the changes in the number of the ON dots. The details will hereinafter be described.

A first example of a method for setting the feed speed in the present embodiment will be explained in concrete terms with reference to FIGS. 4 to 10, using an example, shown in FIG. 4, of printing a pattern that is formed from line segments 61 to 64 on the heat-sensitive tape 8. The horizontal axis of a bar graph 72 in FIG. 4 indicates lines to be printed by the thermal line head 112. The CPU 11 prints the line segments 61 to 64 one line at a time on the heat-sensitive tape 8 by operating the heating elements by controlling the thermal line head 112 on a cycle T. The CPU 11 controls the revolution speed of the drive motor 18 by transmitting a control pulse to the drive motor 18 on a cycle that is the same as the cycle T. Therefore, the horizontal axis also indicates the total number of the control pulses to be transmitted from the CPU 11 to the drive motor 18.

The printer 1 is able to adjust the feed speed through a total of nine levels, from zero to eight. The minimum feed speed is zero. The maximum feed speed is eight. The CPU 11 is able to change the revolution speed of the drive motor 18 through nine levels. That is, the CPU 11 is able to adjust the speed of the heat-sensitive tape 8 that is fed by the platen roller 111 through nine levels. In addition, the drive motor 18 is able to change the feed speed at a specified rate of change. In the present embodiment, in order to change the feed speed by one level, the printer 1 needs one control pulse to be transmitted to the drive motor 18. Therefore, a time of 1T is required in order to change the feed speed by one level. In order to change the feed speed from zero to 8, eight control pulses (a time of 8T) are required.

The CPU 11 first specifies the numbers of ON dots for all of the plurality of lines that make up the pattern. Then, as shown in FIG. 4, the CPU 11 sets groups of the specified numbers of ON dots for the lines in the ranges that are indicated by horizontal bars 50 (51, 52, 53, and the like) in the bar graph 72. Each of the groups that are indicated by the horizontal bars 50 includes ten lines, starting from each one of the plurality of lines that make up the pattern. For example, the horizontal bar 51 starts at the 1st line and includes the 1st to the 10th lines. The horizontal bar 52 starts at the 2nd line and includes the 2nd to the 11th lines. The horizontal bar 53 starts at the 3rd line and includes the 3rd to the 12th lines. All of the horizontal bars that are shown in FIG. 4 are defined in the same manner, although the reference numerals have been omitted. Hereinafter, the first line of any one group will be called a start line of the group. The CPU 11 tentatively specifies the feed speed to be used when an individual line is printed based on the number of ON dots that are specified for that line. Hereinafter, the feed speed that is tentatively specified by the CPU 11 based on the number of ON dots for the line will be called a first speed.

Note that the reasons why the number of lines that are included in each group is ten are because the feed speed is changed through the nine levels and because the feed speed will be adjusted to the first speed just before the specified line is printed.

A table 73 indicates the first speeds (zero to 8) that are specified for the 18th to the 37th lines, respectively, based on the specified numbers of ON dots. The vertical axis of the table 73 indicates the start lines (the 18th to the 28th lines). The horizontal axis indicates the 18th to the 37th lines that will be printed by the thermal line head 112.

Figure 4:
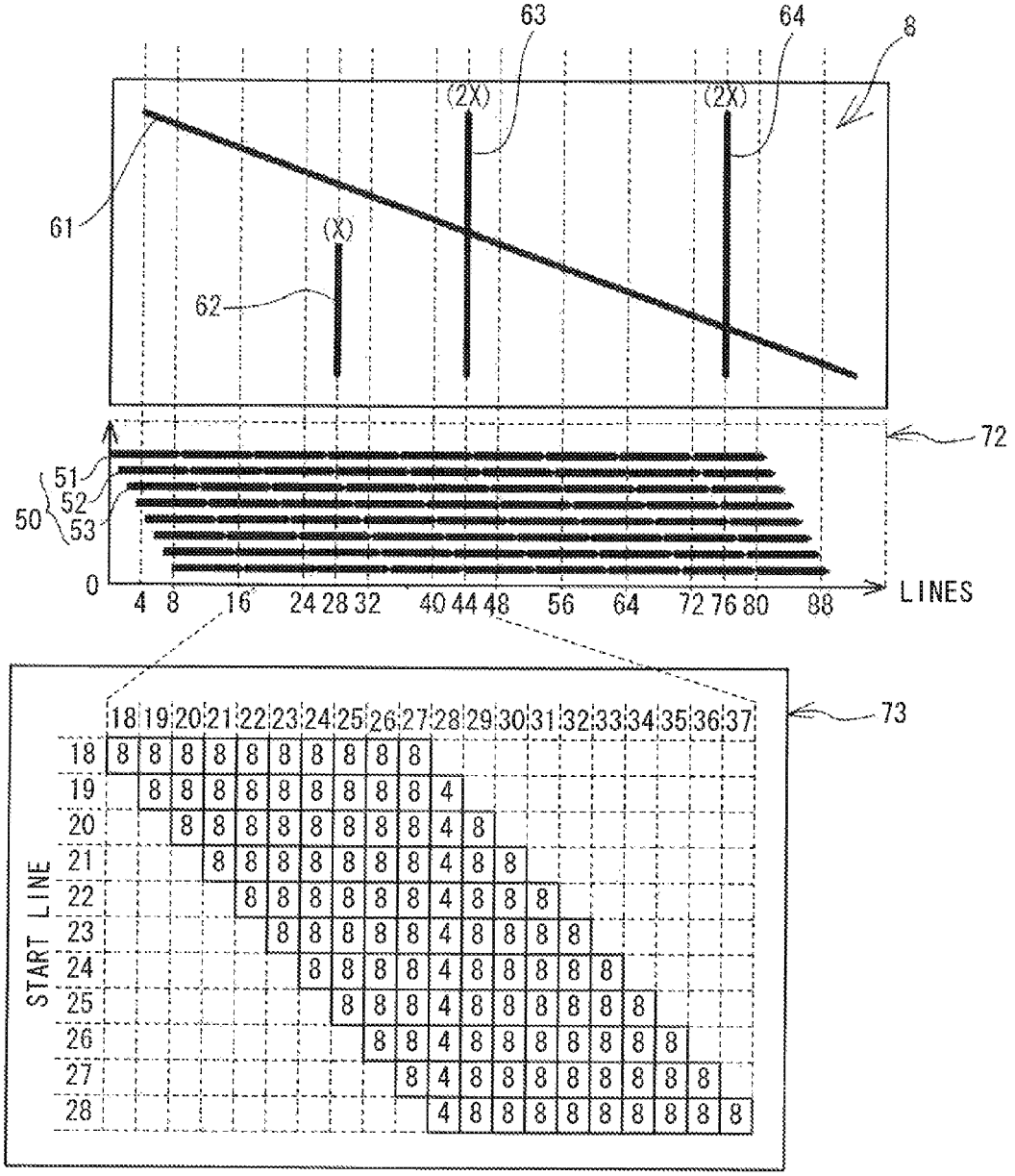
FIG. 4 is a figure that shows a first example of first speeds.

As indicated on the heat-sensitive tape 8 shown in FIG. 4, only the line segment 61 will be printed on the 4th to the 27th lines. The number of ON dots is low in each of the 4th to the 27th lines, so the highest feed speed of 8 may be used as the feed speed that is required in order to print each of the 4th to the 27th lines. Therefore, as shown in the table 73, the CPU 11 specifies 8 as the first speed that corresponds to each one of the 18th to the 27th lines in the group in which the 18th line is the start line.

In contrast, at the 28th line, the printer 1 prints the line segment 62 (with a number X of ON dots) on the heat-sensitive tape 8. When the 28th line is printed, the number of ON dots is large. For example, the feed speed that is required in order to print a line with the number X of ON dots is 4. In this case, the CPU 11 specifies 8 as the first speed that corresponds to each of the 19th to the 27th lines in the group in which the 19th line is the start line, and specifies 4 as the first speed that corresponds to the 28th line. In the same manner, the CPU 11 specifies the numbers of ON dots for each of the lines that belong to the groups in which the 20th to the 28th lines are the start lines, and specify the corresponding first speeds. As a result, as shown in the table 73, the CPU 11 specifies, in each group, the first speed that corresponds to the 28th line as 4, and the first speeds that correspond to the other lines (the 18th to the 27th lines and the 29th to the 37th lines) as 8, respectively.

When the printing of the 28th line is performed, the printer 1 needs to set the feed speed to 4. However, as described previously, the revolution speed of the drive motor 18 cannot be changed rapidly. Therefore, in a case where the printer 1 prints the 27th line with the feed speed of 8, the printer 1 cannot reduce the feed speed to 4 by the time that the printer 1 prints the 28th line immediately thereafter. For that reason, in a case where the CPU 11 changes the feed speed in order to print the 28th line, the CPU 11 gradually changes, in advance, the feed speeds that are used when the lines that precede the 28th line are printed, such that the printer 1 can feed the heat-sensitive tape 8 reliably at the changed feed speed. Specifically, the CPU 11 performs the processing that is described below.

First, the CPU 11 revises the first speeds by applying, to the first speeds that were respectively specified for the lines, speed revisions that are stored in the first table 131 that is shown in FIG. 5. In the first table 131, differences and speed revisions are stored in association with one another. The difference indicates the number of lines between the start line and the line that corresponds to the first speed that is the object of revision. The speed revision is a revision amount for revising the first speed by being added to the first speed. The speed revisions become greater as the differences become greater. The speed revisions are set in advance in accordance with the previously described specified rate of change at which the drive motor 18 can change the feed speed. In the present embodiment, the drive motor 18 is able to change the feed speed by one level in a time of 1T, that is, per one line. Accordingly, the speed revisions are set such that when the difference increases by one line, the speed revision increases by one level. The first table 131 that is shown in FIG. 5 is an example in which the speed revisions of 0, 0, +1, +2, +3, +4, +5, +6, +7, and +8 are associated with the differences of 0, 1, 2, 3, 4, 5, 6, 7, 8, 9, respectively. Note that a difference of 0 means that the line that is the object of revision is the same as the start line. In that case, the speed revision is 0. A difference of 1 means that the start line immediately precedes the line that is the object of revision. In order for the changing of the feed speed to be completed just before a specified line is printed, it is necessary for the feed speed for the immediately preceding line to be the same as the feed speed for the specified line. Accordingly, in a case where the difference is 1, the speed revision is 0.

As an example, a case will be explained in which the first speeds are revised for the 18th to the 27th lines that belong to the group in which the start line is the 18th line. The difference between the 18th line (the start line) and the 18th line is 0. In the first table 131, a speed revision of 0 is associated with the difference of 0. Therefore, the CPU 11 adds the speed revision of 0 to the first speed of 8 for the 18th line (8+0). The difference between the 18th line (the start line) and the 19th line is 1. In the first table 131, a speed revision of 0 is associated with the difference of 1. Therefore, the CPU 11 adds the speed revision of 0 to the first speed of 8 for the 19th line (8+0). The difference between the 18th line (the start line) and the 20th line is 2. In the first table 131, a speed revision of +1 is associated with the difference of 2. Therefore, the CPU 11 adds the speed revision of +1 to the first speed of 8 for the 20th line (8+1). The CPU 11 revises the first speeds for the 21st to the 27th lines in the same manner.

A case in which the first speed of 4 that corresponds to the 28th line is revised will be explained with reference to FIG. 6. In the group in which the 19th line is the start line, the difference between the 19th line (the start line) and the 28th line is 9. The CPU 11 specifies the speed revision of +8 based on the first table 131. The CPU 11 adds the speed revision of +8 to the first speed of 4 for the 28th line (4+8). In the group in which the 20th line is the start line, the difference between the 20th line (the start line) and the 28th line is 8. The CPU 11 specifies the speed revision of +7 based on the first table 131. The CPU 11 adds the speed revision of +7 to the first speed of 4 for the 28th line (4+7). In this manner, the CPU 11 revises the first speed of 4 for the 28th line in each of the groups. By repeating the processing that is similar to the processing described above, the CPU 11 carries out the revisions based on the first table 131 for all of the first speeds that correspond to the lines that belong to the groups in which the start lines are the 18th to the 28th lines, respectively.

Figure 7:
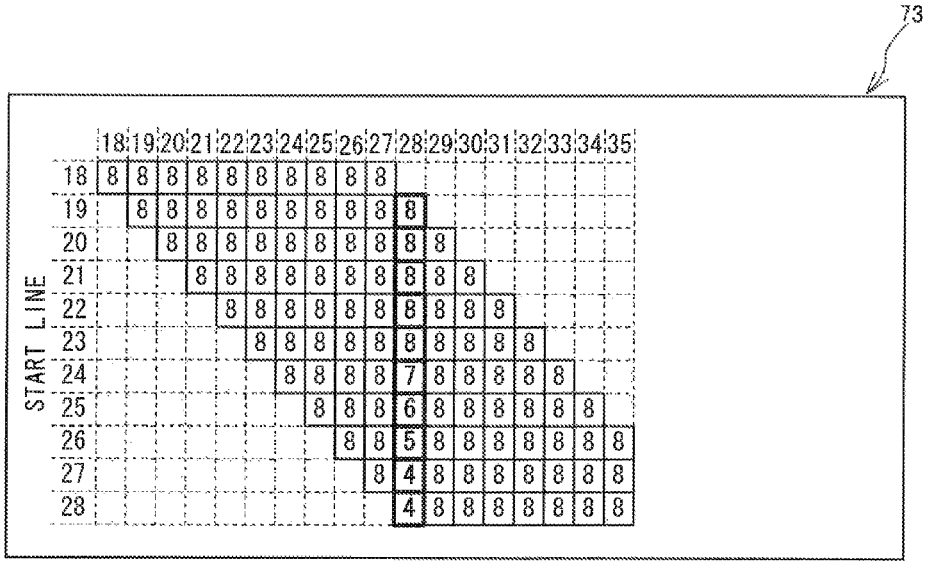
FIG. 7 is a figure that shows the first speeds that have been revised.

As the highest feed speed of the printer 1 is 8, the printer 1 cannot feed the heat-sensitive tape 8 at a feed speed of 9 or greater. Therefore, the CPU 11 adjusts all of the first speeds that have been revised as described above by using 8 as the upper limit. For example, in each of the groups for which the start lines are the 18th to the 22nd lines, respectively, the first speed that corresponds to the 28th line is 9 or greater than 9. Accordingly, the CPU 11 adjusts those first speeds to 8. In contrast, in each of the groups for which the start lines are the 23rd to the 28th lines, respectively, the first speed that corresponds to the 28th line is not greater than 8. Accordingly, the CPU 11 does not adjust the revised first speeds. Next, the CPU 11 changes the table 73 according to the first speeds for which the revisions and the adjustments were carried out as necessary. As a result, the table 73 that is shown in FIG. 6 is changed to the table 73 that is shown in FIG. 7. Through the processing described above, the first speeds for the 28th line in the groups in which the start lines are the 19th to the 28th lines are respectively changed to 8, 8, 8, 8, 8, 7, 6, 5, 4, and 4.

Figure 8:
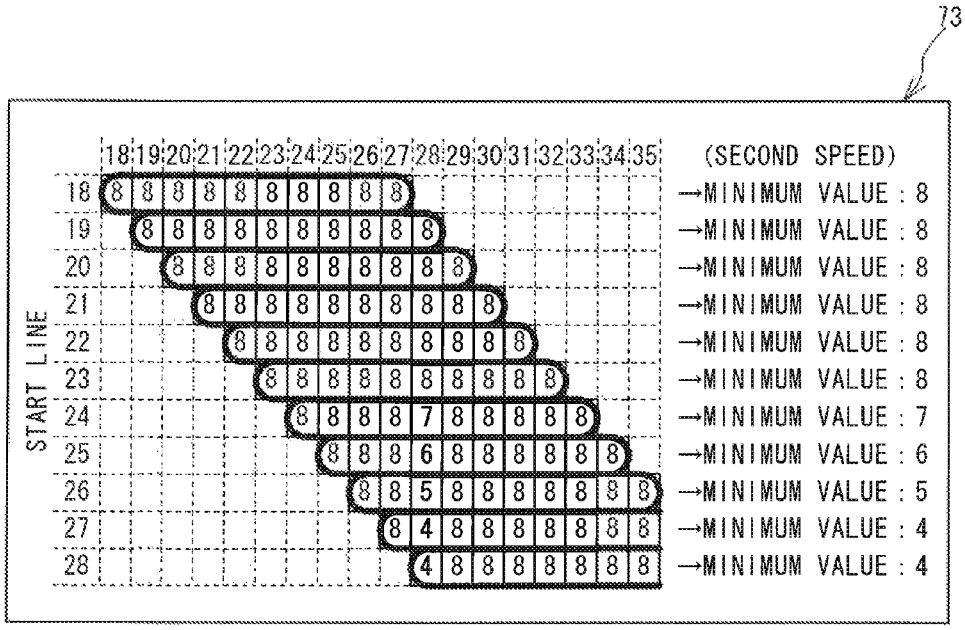
FIG. 8 is an explanatory figure that shows a method of setting second speeds based on the first speeds that have been revised.

Next, the CPU 11 identifies, among the first speeds in the table 73, the lowest first speed in each group. As shown in FIG. 8, the lowest values for the first speeds in the groups in which the start lines are the 18th to the 28th lines are respectively 8, 8, 8, 8, 8, 8, 7, 6, 5, 4, and 4. In the example in FIG. 8, the lowest value for the first speed in each group is the value of the revised first speed for the 28th line in each group. As described previously, the CPU 11 has already revised the first speeds in accordance with the first table 131. Accordingly, the revised first speed for the 28th line in each of the groups in which the start lines are the 18th to the 28th lines gradually decreases by one, as the difference between the 28th line and the start line of each of the groups decreases. The CPU 11 sets the minimum value for the first speed that has been identified for each of the groups as a second speed. The second speed corresponds to a feed speed when the corresponding start line is printed.

As explained previously, in order to change the feed speed by one level, the CPU 11 needs to transmit one control pulse to the drive motor 18. Therefore, in a case where the difference between the feed speeds for the two lines that are consecutively printed is not less than 2, the CPU 11 cannot change the feed speed with a single control pulse from the feed speed for one of the two lines that is printed first to the feed speed for the other of the two lines that is subsequently printed. Therefore, the CPU 11 changes the second speed as necessary, such that the second speed can be reached with a single control pulse. Of the feed speeds for the two lines that are consecutively printed, the feed speed for the line that is printed first is hereinafter referred to as the previous feed speed, and the feed speed for the other line that is subsequently printed is hereinafter referred to as the subsequent feed speed.

Specifically, the CPU 11 changes the second speed as necessary by applying the second table 132 that is shown in FIG. 9 to the second feed speeds that were set as shown in FIG. 8. The second table 132 shows the feed speeds to which the previous feed speed can actually be changed in a case where an attempt is made to change the previous feed speed to the subsequent feed speed.

For example, the second speeds for the 18th and 19th lines are both 8 (refer to FIG. 8). In the second table 132, the feed speed of 8 is associated with the previous feed speed of 8 and the subsequent feed speed of 8. The associated feed speed of 8 is the same with the second speed of 8 for the 19th line. Therefore, the CPU 11 does not change the second speed of 8 for the 19th line. To take another example, the second speeds for the 23rd and 24th lines are 8 and 7, respectively (refer to FIG. 8). The feed speed of 7 is associated with the previous feed speed of 8 and the subsequent feed speed of 7. The associated feed speed of 7 is the same with the second speed of 7 for the 24th line. Therefore, the CPU 11 does not change the second speed of 7 for the 24th line. To take still another example, the second speeds for the 25th and 26th lines are 6 and 5, respectively (refer to FIG. 8). The feed speed of 5 is associated with the previous feed speed of 6 and the subsequent feed speed of 5. The associated feed speed of 5 is the same with the second speed of 5 for the 26th line. Therefore, the CPU 11 does not change the second speed of 5 for the 26th line. Thus, in a case where the difference between the second speeds of the two lines that are consecutively printed is never greater than 1, each of the second speeds can be reached by a single control pulse. Therefore, even if the CPU 11 applies the second table 132 to the second speeds, the CPU 11 does not change the second speed, as described above.

Note that in a case where the second speed for the start line in a certain group is larger than the second speed for the start line of the next group (i.e. the line to be printed next), that is, in a case where the feed speed decreases, the second feed speeds will not change, even if the second table 132 is applied. The reason is that the CPU 11 has already adjusted the second speeds for the consecutive lines such that the second speeds for the consecutive lines decrease by one level, by revising the first speeds using the first table 131, as explained previously. In contrast, in a case where the second speed for the start line in a certain group is smaller than the second speed for the start line of the next group, that is, in a case where the feed speed increases, the CPU 11 may change the second speeds as necessary, by applying the second table 132. The details will be described later with reference to FIG. 14.

The CPU 11 ultimately sets the second speeds that have been changed as necessary as the feed speeds that will be used when the corresponding lines are respectively printed. The CPU 11 stores the set second speeds in the third table 121 in association with information (in FIG. 10, the line number) that identifies the lines. The identifying information for the lines and the second speeds are stored in the third table 121 as shown in FIG. 10. The second speed indicates the feed speed that will be used when the corresponding line is printed. As shown in the third table 121, in order for the heat-sensitive tape 8 to be fed at the feed speed of 4 when the 28th line is printed, the feed speeds that are used when the 24th to the 27th lines are printed are gradually reduced in the sequence 7, 6, 5, 4. The printing of the 28th line can be performed appropriately by setting the feed speed to 4 for the printing of the 27th line, which immediately precedes the 28th line.

Figure 11:
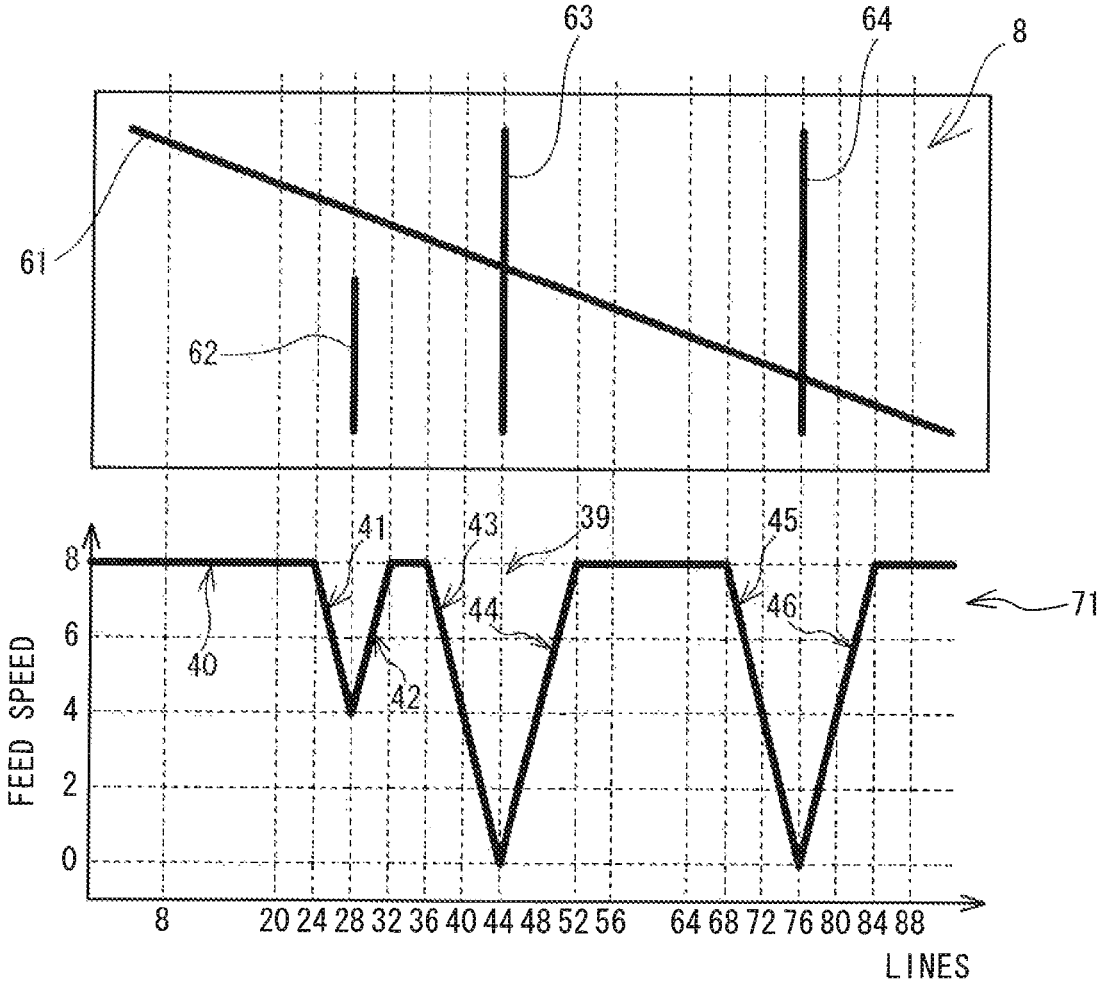
FIG. 11 is a figure that shows transitions in feed speeds.

The method by which the CPU 11 controls the feed speed based on the third table 121 will be explained in specific terms with reference to FIG. 11. In the third table 121, a second speed of 8 is associated with the 18th line, so the CPU 11 sets the control pulse for setting the feed speed to 8 at the 18th line. The CPU 11 transmits the control pulse to the drive motor 18 at the time when the printing of the 18th line is performed. Next, because a second speed of 8 is associated with the 19th line in the third table 121, the CPU 11 sets the control pulse for setting the feed speed to 8 at the 19th line. The CPU 11 transmits the control pulse to the drive motor 18 at the time when the printing of the 19th line is performed, that is, after the cycle T has elapsed after the printing of the 18th line is finished. During the printing of the 18th to the 23rd lines, the CPU 11 repeats the processing that has been described above. The feed speed of 8 is thus maintained while the 18th to 23rd lines are printed (the horizontal line segment 40 in the line graph 71).

In the third table 121, a second speed of 7 is associated with the 24th line, so the CPU 11 sets the control pulse for setting the feed speed to 7 at the 24th line. The CPU 11 transmits the control pulse to the drive motor 18 at the time when the printing of the 24th line is performed. In the third table 121, a second speed of 6 is associated with the 25th line, so the CPU 11 sets the control pulse for setting the feed speed to 6 at the 25th line. The CPU 11 transmits the control pulse to the drive motor 18 at the time when the printing of the 25th line is performed. During the printing of the 24th to the 27th lines, the CPU 11 repeats the processing that has been described above. The feed speed thus decreases from 8 to 4 while the 24th to 27th lines are printed (the descending line segment 41 in the line graph 71). In the third table 121, a second speed of 4 is associated with the 28th line, so the CPU 11 sets the control pulse for setting the feed speed to 4 at the 28th line. The CPU 11 transmits the control pulse to the drive motor 18 at the time when the printing of the 28th line is performed. At the same time, the CPU 11 operates the thermal line head 112 such that the line segment 62 will be printed on the heat-sensitive tape 8. The thermal head 62 thus prints the line segment 62 on the heat-sensitive tape 8.

In a case where the CPU 11 controls the feed speed based on the third table 121, the CPU 11 starts reducing the feed speed at the point when the 24th line is printed (the descending line segment 41 in the line graph 71). Then the feed speed becomes 4 at the point when the printing of the 27th line, which immediately precedes the 28th line, is performed (the descending line segment 41 in the line graph 71). In this manner, in a case where the CPU 11 controls the feed speed based on the third table 121, the feed speeds that are used when the 20th to the 28th lines are printed become faster. At the point when the 28th line is printed, the feed speed has been changed to 4. Therefore, the printer 1 can perform the printing of the line segment 62 appropriately. By feeding the heat-sensitive tape 8 more quickly, the printer 1 is able to print the pattern appropriately on the heat-sensitive tape 8 while it shortens the time that is required to complete the printing on the heat-sensitive tape 8.

Figure 12:
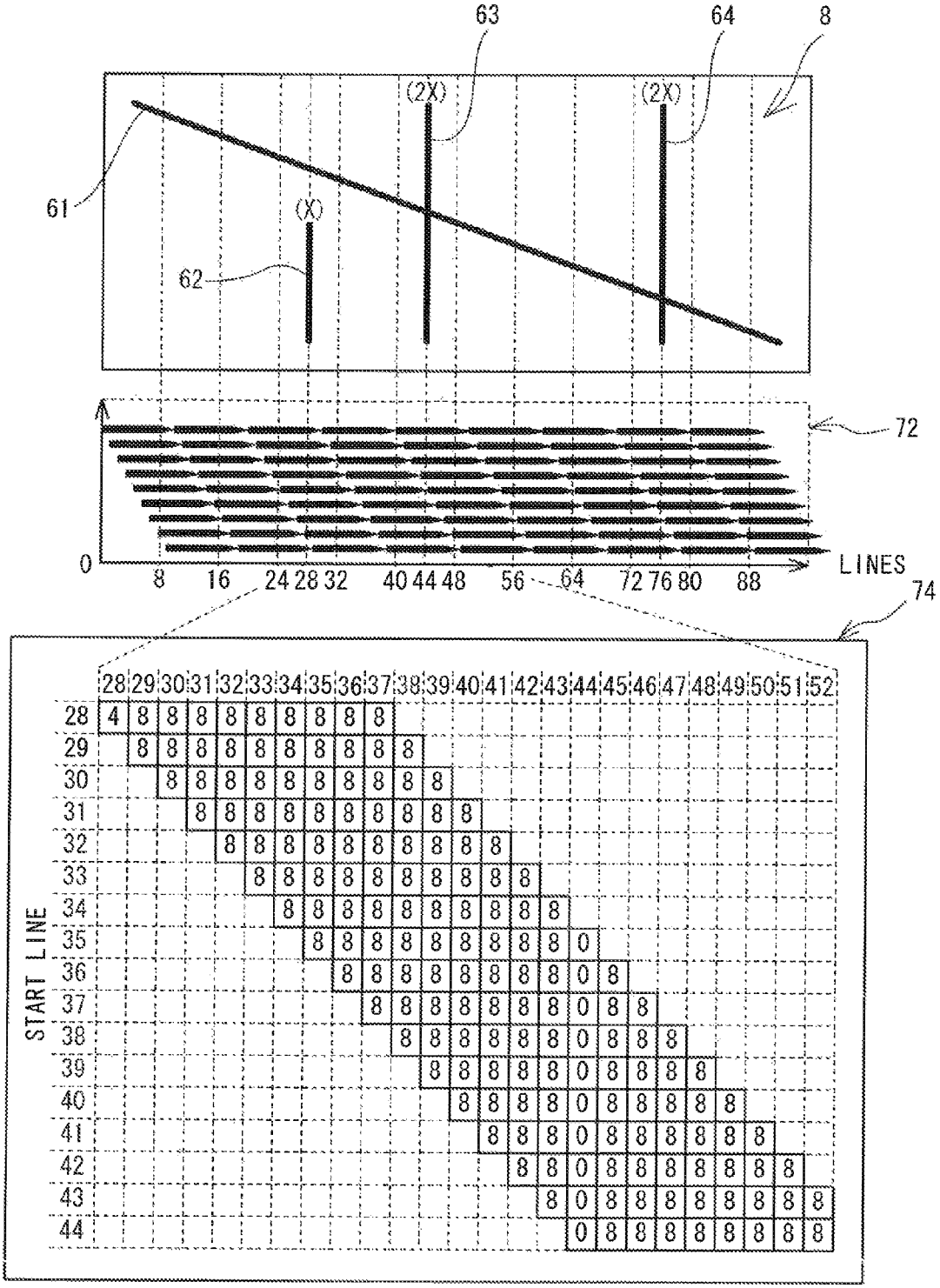
FIG. 12 is a figure that shows a second example of the first speeds.

A second example of the method for setting the feed speed in the present embodiment will be explained in specific terms with reference to FIGS. 12 to 15. A table 74 in FIG. 12 shows the first speeds (0 to 8) that are specified for the 28th to the 52nd lines, respectively, based on the numbers of ON dots in the lines in each of the groups that respectively start at the 28th to the 44th lines. As indicated on the heat-sensitive tape 8 that is shown in FIG. 12, the printer 1 prints the line segment 62 (with the number X of ON dots) at the 28th line, and prints the line segment 63 (with a number 2X of ON dots) at the 44th line. Hereinafter, an example will be used in which the feed speed that is required for printing the 28th line is 4, the feed speed that is required for printing the 44th line is 0, and the feed speed that is required for printing the 29th to the 43rd lines and the 45th to the 52nd lines is 8.

Figure 13:
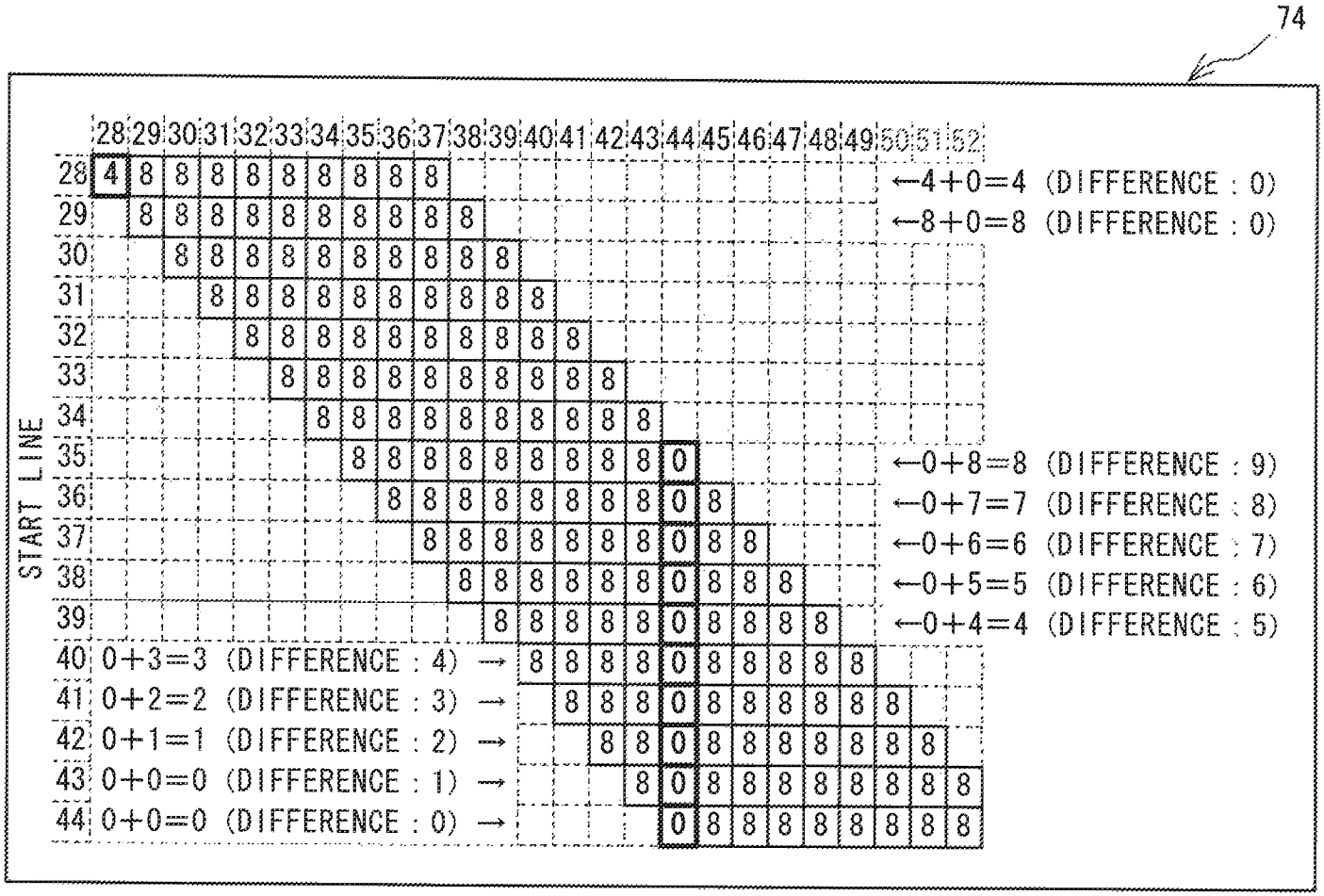
FIG. 13 is an explanatory figure that shows a method of revising the first speeds of the second example.

As shown in FIG. 13, the CPU 11 revises the first speeds by applying the speed revisions that are stored in the first table 131 (refer to FIG. 5) to the first speeds that have been specified corresponding to the individual lines. For example, in the group in which the 28th line is the start line, the difference between the 28th line (the start line) and the 28th line is 0. Therefore, the CPU 11 adds the speed revision of 0 (refer to FIG. 5) to the first speed of 4 for the 28th line (4+0). The difference between the 28th line (the start line) and the 29th line is 1. Therefore, the CPU 11 adds the speed revision of 0 to the first speed of 8 that corresponds to the 29th line (8+0). In the group in which the 35th line is the start line, the difference between the 35th line (the start line) and the 44th line is 9. Therefore, the CPU 11 adds the speed revision of +8 (refer to FIG. 5) to the first speed of 0 that corresponds to the 44th line (0+8). In the group in which the 36th line is the start line, the difference between the 36th line (the start line) and the 44th line is 8. Therefore, the CPU 11 adds the speed revision of +7 (refer to FIG. 5) to the first speed of 0 that corresponds to the 44th line (0+7). In this manner, the CPU 11 carries out the revisions for all of the first speeds that respectively correspond to the lines that belong to the groups for which the start lines are the 28th to the 44th lines.

Figure 14:
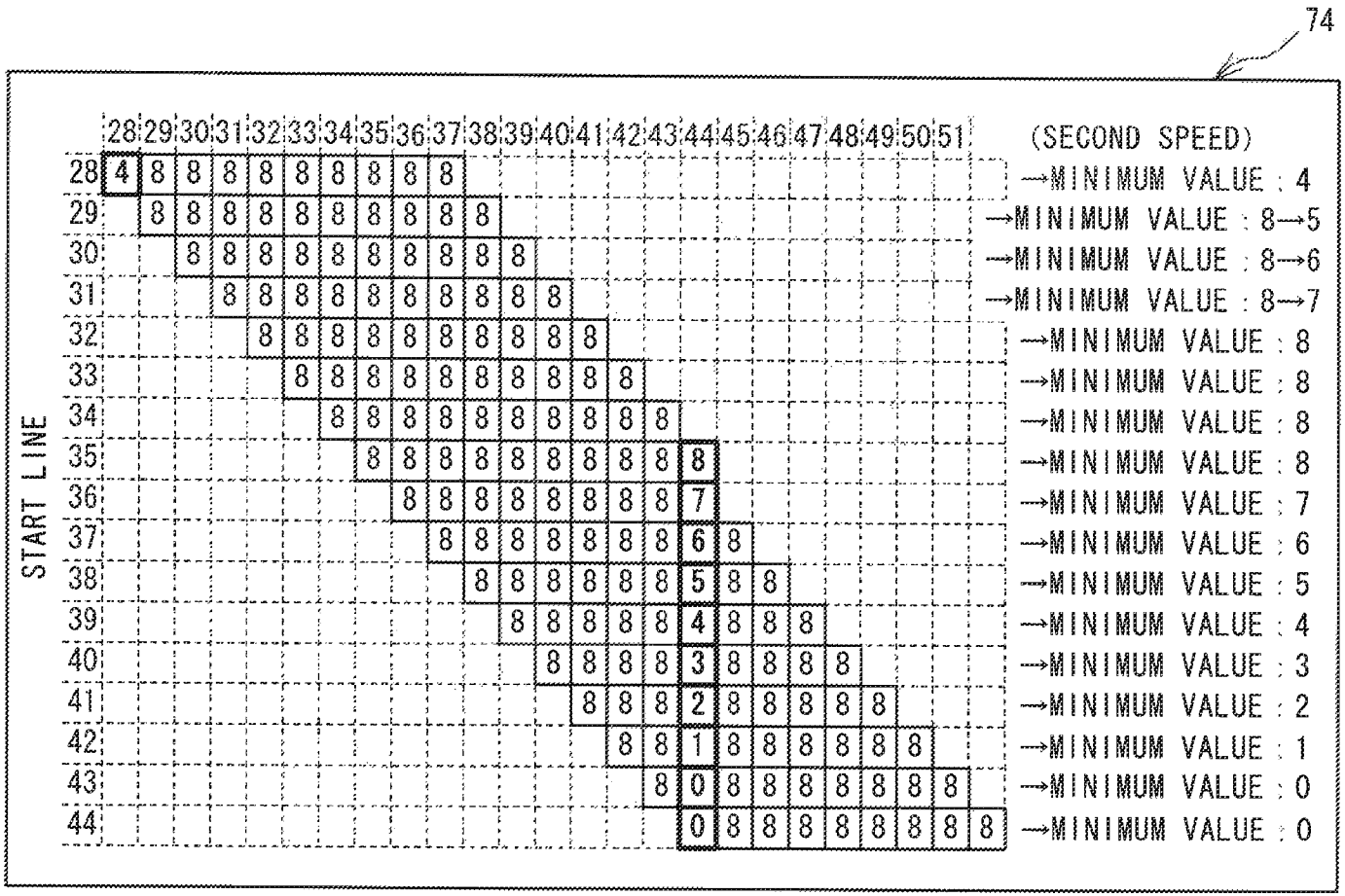
FIG. 14 is an explanatory figure that shows a method of setting second speeds based on the first speeds that have been revised.

The CPU 11 adjusts all of the first speeds that have been revised as described above by using 8 as the upper limit. Note that in the table 74, the revised first speeds are all not greater than 8. The CPU 11 changes the table 74 according to the first speeds that have been revised and appropriately adjusted. As a result, the table 74 that is shown in FIG. 13 is changed to the table 74 that is shown in FIG. 14. In the groups in which the start lines are the 35th to the 44th lines, respectively, the first speeds that correspond to the 44th line are set as 8, 7, 6, 5, 4, 3, 2, 1, 0, and 0, respectively. The CPU 11 sets, as the second speed for the start line of the group, the lowest first speed in each group among the first speeds in the table 74. The second speeds for the groups in which the start lines are the 28th to the 44th lines are 4, 8, 8, 8, 8, 8, 8, 8, 8, 7, 6, 5, 4, 3, 2, 1, 0, and 0, respectively.

The CPU 11 changes the second speeds as necessary, by applying the second table 132 (refer to FIG. 9) to the set second speeds. Specifically, this is done as hereinafter explained. For example, the second speeds for the 28th and the 29th lines are respectively 4 and 8 (refer to FIG. 14). In the second table 132, the feed speed of 5 is associated with the previous feed speed of 4 and the subsequent feed speed of 8. The associated feed speed of 5 is different from the second speed of 8 for the 29th line. Accordingly, the CPU 11 changes the second speed for the 29th line from 8 to 5. To take another example, the second speeds for the 29th and the 30th lines are respectively 5 and 8 (refer to FIG. 14). In the second table 132, the feed speed of 6 is associated with the previous feed speed of 5 and the subsequent feed speed of 8. The associated feed speed of 6 is different from the second speed of 8 for the 30th line. Accordingly, the CPU 11 changes the second speed for the 30th line from 8 to 6. In this manner, the CPU 11 changes the second speeds that correspond to the 29th, 30th, and 31st lines (the start lines).

In the example that is shown in FIG. 14, unlike the example in FIG. 8, the second speed of 4 for the 28th line is slower than the second speed of 8 for the 29th line. That is, the printer 1 will increase the feed speed when the 29th line is printed. Therefore, the CPU 11 changes the second speeds as necessary by applying the second table 132 as previously described.

The CPU 11 stores the second speeds that have been changed as necessary in the third table 121 (refer to FIG. 15) in association with information (in FIG. 15, the line number) that identifies the corresponding lines, as described above. In a case where the CPU 11 controls the feed speed based on the third table 121 that is shown in FIG. 15, the printer 1 prints the 28th line at the feed speed of 4. Then the feed speeds that are used when the 29th to the 31st lines are printed are increased step by step to 5, 6, and 7, respectively. At the point when the 32nd line is printed, the second speed reaches the feed speed of 8. Furthermore, the feed speeds when the printings of the 36th to the 43rd lines are performed are decreased step by step to 7, 6, 5, 4, 3, 2, 1, and 0, respectively, such that feed the heat-sensitive tape 8 can be fed at the feed speed of 0 when the printing of the 44th line is performed. The second speed becomes 0 at the point when the 43rd line, which immediately precedes the 44th line, is printed.

The transitions in the feed speed (in the portion indicated by the arrow 39 in the line graph 71) in a case where the CPU 11 controls the feed speed based on the third table 121 (refer to FIG. 15) will be explained with reference to FIG. 11. In a case where the CPU 11 controls the feed speed based on the third table 121, the feed speed is increased step by step starting at the point when the 29th line, which immediately follows the 28th line, is printed (the ascending line segment 42 in the line graph 71) (refer to FIG. 15). The feed speed reaches 8 at the point when the 32nd line is printed (the ascending line segment 42 in the line graph 71). The feed speed is decreased step by step starting at the point when the 36th line is printed (the descending line segment 43 in the line graph 71) (refer to FIG. 15). The feed speed reaches 0 at the point when the 43rd line, which immediately precedes the 44th line, is printed (the descending line segment 43 in the line graph 71).

Thus, in a case where the CPU 11 controls the feed speed based on the third table 121, the feed speeds when the 29th to the 43rd lines are printed become faster. At the point when the 44th line is printed, the feed speed has been changed to 0, and so the line segment 63 can be printed appropriately. Because the printer 1 is able to feed the heat-sensitive tape 8 more quickly, the time that is required in order to complete the printing on the heat-sensitive tape 8 can be shortened.

As described above, the printer 1 is able to set the second speed, which is the feed speed to be used when the line to be printed before the specified line is printed, such that the heat-sensitive tape 8 is fed at the first speed to be used when the specified line is printed. This makes it possible for the printer 1 to change the feed speed efficiently, such that the feed speed becomes the first speed when the specified line is printed. The printer 1 is therefore able to shorten the time that is required to complete the printing of the pattern on the heat-sensitive tape 8.

Setting the second speed based on the first table 131 makes it possible for the printer 1 to set, to the fastest possible speed, the second speed that is required in order for the specified line to be printed at the first speed. The reason for this will now be described. In the first table 131, the speed revisions are set according to the number of lines between the specified line and the start line. Specifically, in a case where the number of lines between the specified line and the start line is large, the time that elapses until the feed speed is set to the first speed when the specified line is printed is long. Accordingly, the speed revision is set to a large value. Accordingly, the second speed when the start line is printed becomes very much faster than the first speed. In contrast, in a case where the number of lines between the specified line and the start line is small, the time that elapses until the feed speed is set to the first speed when the specified line is printed is short. Accordingly, the speed revision is set to a small value. The second speed when the start line is printed is close to the first speed. Therefore, the feed speed is decreased gradually and is changed to the first speed just before the specified line is printed. Thus the printer 1 is easily able to control the feed speed such that the feed speed becomes the first speed just before the specified line is printed. Therefore, the printer 1 is easily able to shorten the time that is required in order to complete the printing on the heat-sensitive tape 8.

Figure 16:
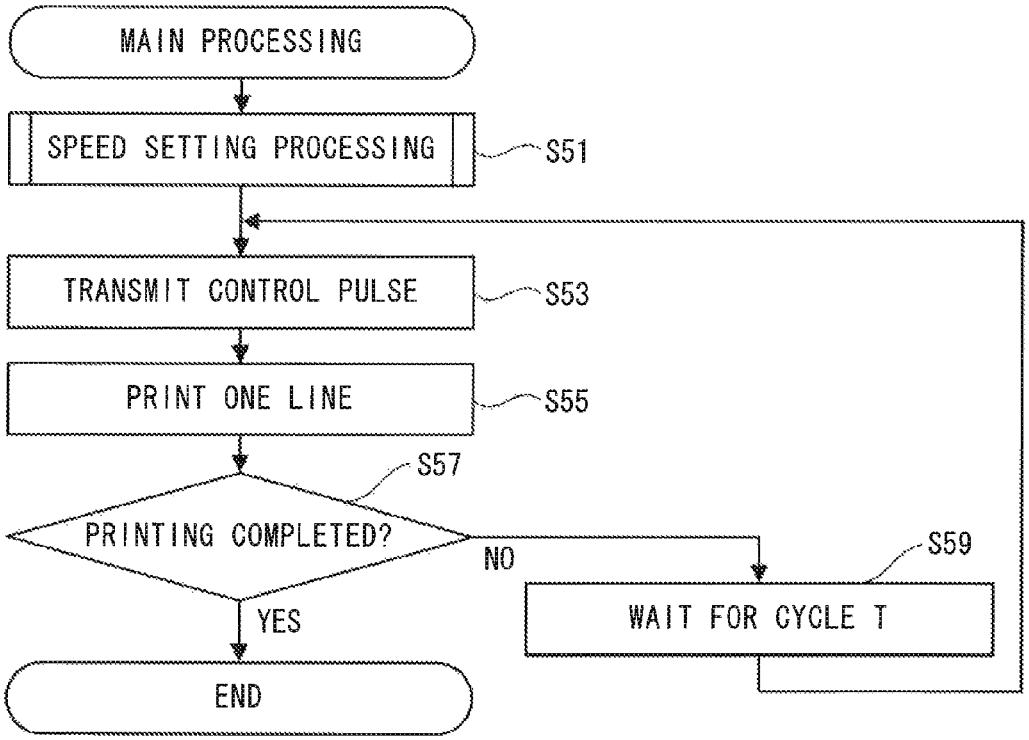
FIG. 16 is a flowchart of main processing.
Figure 17:
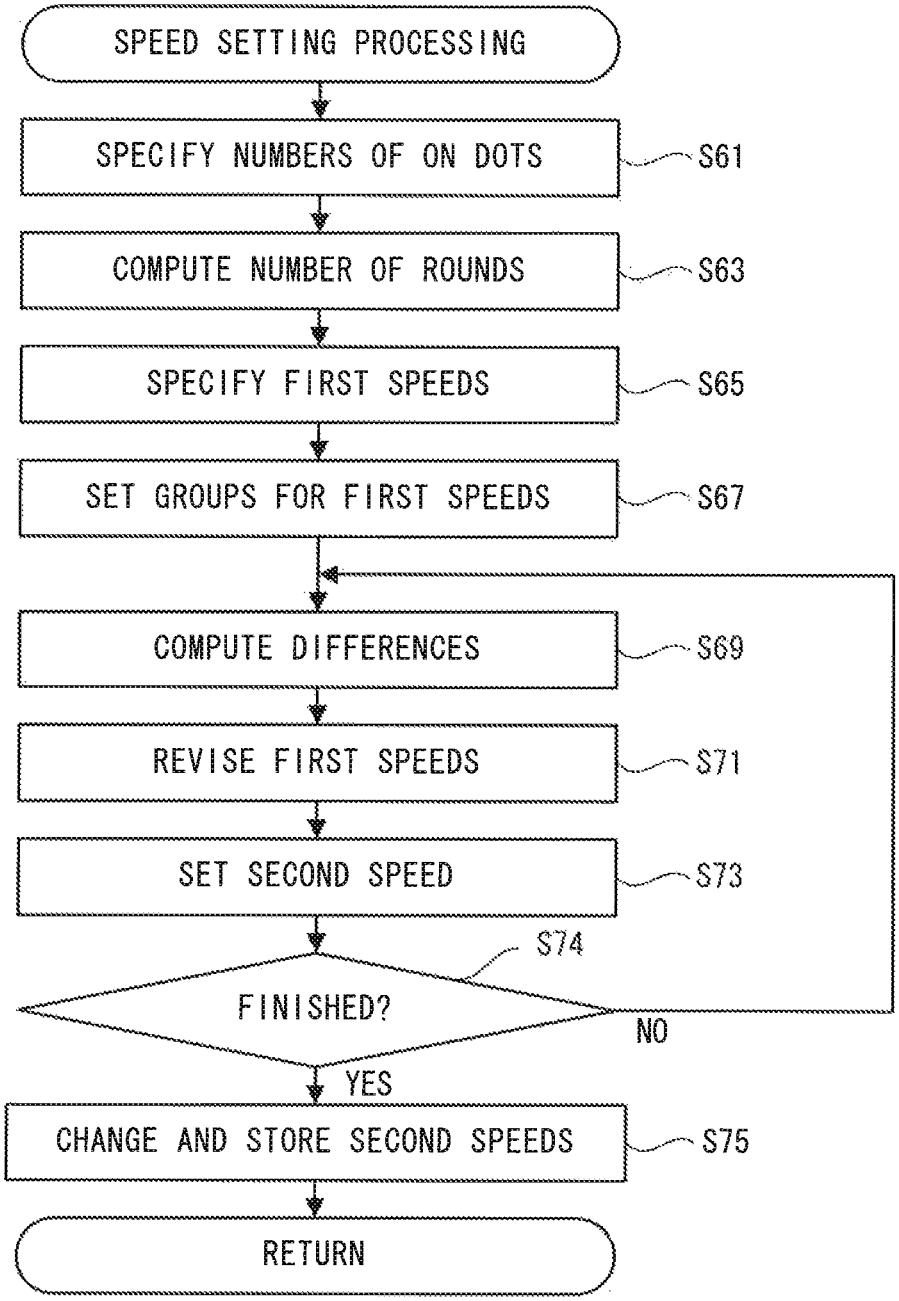
FIG. 17 is a flowchart of speed setting processing.

The processing (main processing) in a case where the control that has been described above is performed by the CPU 11 will be explained in specific terms with reference to FIGS. 16 and 17. As shown in FIG. 16, first, the CPU 11 performs processing (speed setting processing; refer to FIG. 17) that sets the second speeds based on the numbers of the ON dots (Step S51). As shown in FIG. 17, first, the CPU 11 specifies the numbers of the ON dots for all of the lines, based on the printing data (Step S61). The CPU 11 computes the number of rounds of operation for each line by dividing the specified number of the ON dots in each line by the number of the heating elements that can be operated at the same time (Step S63). The number of rounds of operation is the number of rounds in a case where the heating elements are operated in group units over a plurality of rounds. Based on the computed numbers of rounds of operation, the CPU 11 sets an optimum first speed for each line to one of the nine levels (Step S65). For example, the flash ROM 13 may store a table (not shown) in which correspondence relationships between the numbers of rounds of operation and the optimum first speeds are defined. The CPU 11 may set the first speeds by referencing the table.

The CPU 11 sets groups for the first speeds, each of the groups including the first speeds for ten lines, starting from each one of the lines as the start line (Step S67) (refer to FIG. 4). The CPU 11 selects one of the set groups as the object of the processing and computes the number of lines (the difference) between the start line and each one of the lines in the group (Step S69). The CPU 11 revises the first speed for each line by applying the difference that was computed at Step S69 to the first table 131 (refer to FIG. 5) (Step S71) (refer to FIGS. 6 and 7). The CPU 11 sets the lowest value among the revised first speeds as the second speed for the start line of the group that is the object of processing (Step S73) (refer to FIG. 8).

The CPU 11 determines whether a second speed has been set for every one of the groups that were set at Step S67 (Step S74). In a case where a group remains for which the second speed has not been set (NO at Sp S74), the CPU 11, in order to set the second speed for the remaining group, returns to the processing at Step S69. The CPU 11 then defines the next unprocessed group as the object of the processing, and performs the processing at Steps S69 to S73. In a case where the CPU 11 has set the second speed for every one of the groups (YES at Step S74), the CPU 11 uses the second table 132 (refer to FIG. 9) to change, as necessary, the second speed for the start line of each group (Step S75). The CPU 11 stores the second speeds that have been changed as necessary in the third table 121 in association with the identifying information for the corresponding lines (Step S75) (refer to FIGS. 10 and 15).

As shown in FIG. 16, after the speed setting processing (Step S51) has finished, the CPU 11 sets the control pulse based on the second speed that was set by the speed setting processing and stored in the third table 121. The CPU 11 transmits the control pulse to the drive motor 18 (Step S53). At the same time, the CPU 11 performs the printing of one line on the heat-sensitive tape 8 by operating the thermal line head 112 (Step S55). The CPU 11 determines whether the printing of all of the lines has been completed (Step S57). In a case where the printing of all of the lines has not been completed (NO at Step S57), the CPU 11 waits for one cycle T (Step S59). The CPU 11 then returns to the processing at Step S53 in order to perform the printing of the remaining lines. In a case where the printing of all of the lines has been completed (YES at Step S57), the CPU 11 terminates the main processing.

Another embodiment of the present disclosure will be hereinafter described with reference to FIGS. 18 to 23. In the following embodiment, the CPU 11 divides the plurality of lines into a plurality of pairs of lines. The pair that includes two lines thus obtained is hereinafter called as a block. In a case where the CPU 11 reduces the feed speed in order to appropriately print a line that is included in a specified block, which is one of the plurality of blocks, the CPU 11 may control the feed speed such that the speed reduction is completed just before the printing of the line in the specified block is performed.

The present embodiment explains an example in which the number of lines that are included in each block is two. The number of lines that are included in each block, however, may be one, three, or more. Note that the embodiment that is described previously is an example in which the number of lines in each block is one.

Figure 18:
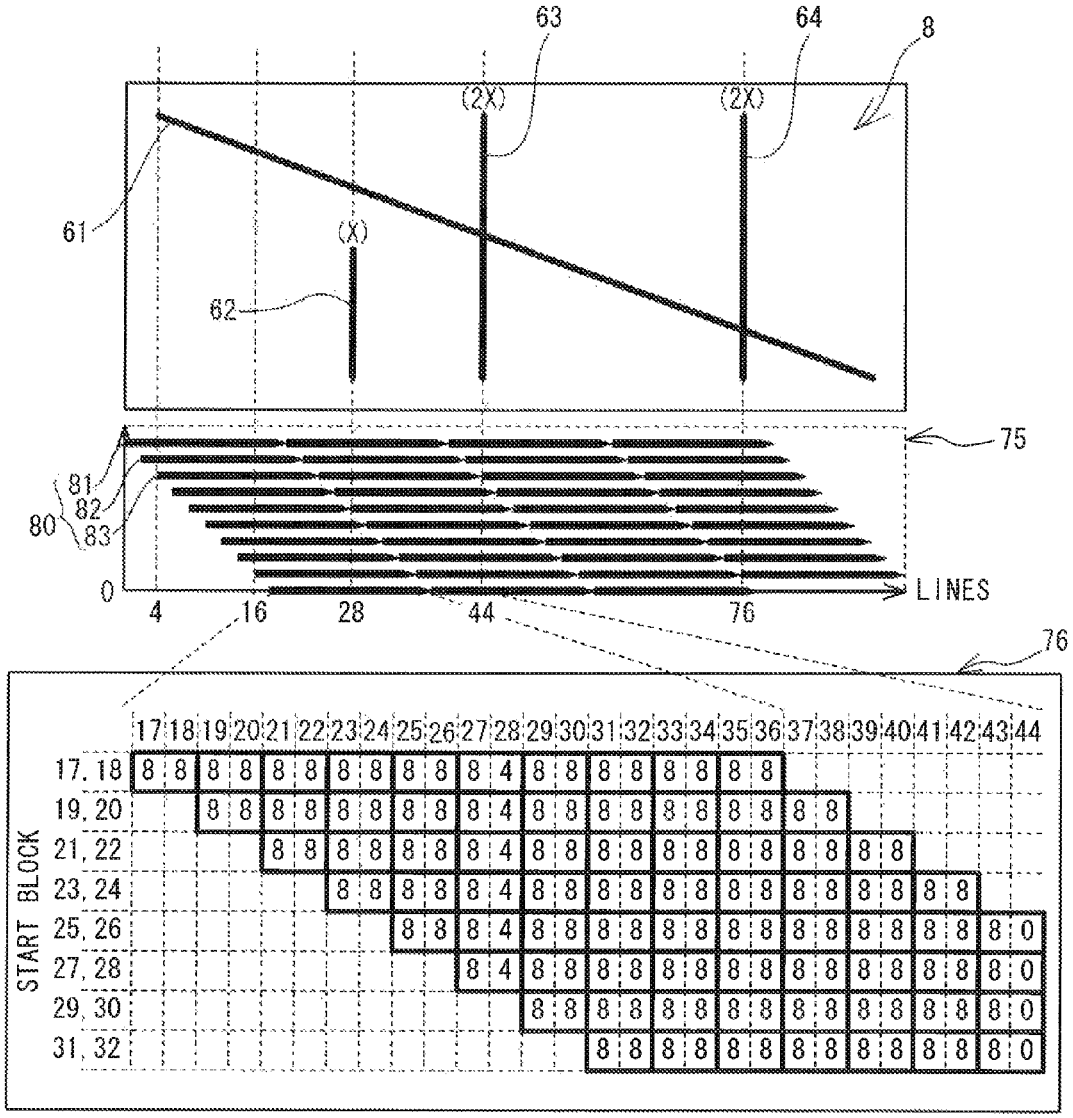
FIG. 18 is a figure that shows feed speeds that correspond to lines in another embodiment.

As in the embodiment that is described previously, the CPU 11 identifies the numbers of ON dots for all of the plurality of lines that make up the pattern, and specifies the feed speeds for the respective lines based on the numbers of ON dots. The CPU 11 then sets a plurality of blocks by dividing the plurality of lines, for which the feed speeds were specified, into a plurality of pairs of lines. Hereinafter, a block that includes two lines X and Y will be expressed as a block (X, Y). Then, as shown in FIG. 18, the CPU 11 sets groups of a plurality of the blocks in the ranges that are indicated by horizontal bars 80 (81, 82, 83, and the like). Each of the groups that are indicated by the horizontal bars 80 includes ten blocks, starting from each one of the plurality of blocks. For example, the horizontal bar 81 starts at the block (1, 2) that includes 1st and 2nd lines and includes the blocks (1, 2) to (19, 20). The horizontal bar 82 starts at the block (3, 4) that includes 3rd and 4th lines and includes the blocks (3, 4) to (21, 22). All of the horizontal bars that are shown in FIG. 18 are defined in the same manner, although the reference numerals have been omitted. Hereinafter, the first block of any one group will be called a start block of the group. A table 76 indicates the feed speeds that are specified for the 17th to 44th lines in blocks. The vertical axis of the table 76 indicates the start blocks (blocks (17, 18) to (31, 32)).

The CPU 11 then specifies the feed speed that corresponds to each of the blocks based on the two feed speeds that have been specified by the CPU 11 based on the numbers of ON dots for the two lines that are included in the block. Specifically, the CPU 11 specifies, as the feed speed for the block (that is, for the two lines in the block), the slower one of the feed speeds that correspond to the two lines in the block.

In a case where the number of lines that are included in each block is three or more, the CPU 11 may specify, as the feed speed for the block (that is, for the plurality of lines in the block), the slowest one of the feed speeds that have been specified by the CPU 11 based on the numbers of ON dots, corresponding to the plurality of lines in each block. In a case where the number of lines that are included in each block is one, the CPU 11 may specify, as the feed speed for the block (that is, for the one line in the block), the feed speed that has been specified by the CPU 11 based on the number of ON dots, corresponding to the one line in each block. Note that the embodiment that is described previously is an example in which the number of lines in each block is one, and the feed speed that has been specified by the CPU 11 based on the number of ON dots for each line is set as the first speed. In the present embodiment, the feed speed that has been specified by the CPU 11 based on the numbers of ON dots for each block is called the first speed.

In the example in FIG. 18, the feed speeds for the 27th and 28th lines that are included in the block (27, 28) are 8 and 4, respectively. Accordingly, the CPU 11 specifies the slower feed speed of 4 as the first speed that corresponds to the block (27, 28). The feed speeds for the 43rd and 44th lines that are included in the block (43, 44) are 8 and 0, respectively. Accordingly, the CPU 11 specifies the slower feed speed of 0 as the first speed that corresponds to the block (43, 44). In all of the other blocks, the feed speeds of the two lines are 8. Accordingly, the CPU 11 specifies the feed speed of 8 as the first speed for each of these blocks. As s result, the CPU 11 changes the table 76 in FIG. 18 to the table 76 in FIG. 19, with the specified first speeds.

The CPU 11 gradually changes the feed speeds for the blocks that are printed before the block (27, 28) in the same manner as in the previous embodiment. Specifically, the CPU 11 performs the following processing. First, the CPU 11 revises the first speeds by applying, to the first speeds that were respectively specified for the blocks, speed revisions that are stored in the first table 131 that is shown in FIG. 5. In the present embodiment, the difference in the first table 131 indicates the number of blocks between the start block and the block that corresponds to the first speed that is the object of revision.

A case in which the first speed of 4 that corresponds to the block (27, 28) is revised will be explained with reference to FIG. 19. In the group in which the block (17, 18) is the start block, the difference between the block (17, 18) (the start block) and the block (27, 28) is 5. The CPU 11 adds the speed revision of +4, which is specified based on the first table 131, to the first speed of 4 for the block (27, 28) (4+4). In the group in which the block (19, 20) is the start block, the difference between the block (19, 20) (the start block) and the block (27, 28) is 4. The CPU 11 adds the speed revision of +3, which is specified based on the first table 131, to the first speed of 4 for the block (27, 28) (4+3). In this manner, the CPU 11 revises the first speed of 4 for the block (27, 28) in each of the groups.

By repeating the processing that is described above, the CPU 11 carries out the revisions based on the first table 131 for all of the first speeds that correspond to the blocks that belong to the groups in which the start blocks are the blocks (17, 18) to (31, 32), respectively. The CPU 11 then adjusts all of the first speeds that have been revised as described above by using 8 as the upper limit. As a result, the table 76 in FIG. 19 is changed to the table 76 that is shown in FIG. 20. The first speeds for the block (27, 28) in the groups in which the start blocks are the blocks (17, 18) to (27, 28) are respectively changed to 8, 7, 6, 5, 4, and 4. The first speeds for the block (43, 44) in the groups in which the start blocks are the blocks (25, 26) to (31, 32) are respectively changed to 8, 7, 6, and 5.

The CPU 11 sets, among the first speeds in table 76, the slowest first speed in each group as the second speed. As shown in FIG. 20, the second speeds for the blocks (17, 18) to (31, 32) are set to 8, 7, 6, 5, 4, 4, 6 and 5, respectively.

The CPU 11 applies the second table 132 that is shown in FIG. 9 to the second speeds that have been set as shown in FIG. 20. The CPU 11 thus changes the second speeds as necessary, such that the second speed for the start block in a certain group can be changed to the second speed for the start block in the next group (i.e. the block to be printed next) with a single control pulse.

For example, the second speeds for the blocks (27, 28) and (29, 30) are respectively 4 and 6. In the second table 132, the feed speed of 5 is associated with the previous feed speed of 4 and the subsequent feed speed of 6. Accordingly, the CPU 11 changes the second speed for the block (29, 30) from 6 to 5. In this manner, the CPU 11 changes the second speeds that correspond to the blocks (17, 18) to (31, 32) to 8, 7, 6, 5, 4, 4, 5 and 5, respectively. The CPU 11 stores the second speeds that have been changed as necessary in the third table 121, in association with the information that identifies the blocks. As shown in FIG. 21, the identifying information for the blocks (the block numbers) and the second speeds are stored in the third table 121.

Figure 22:
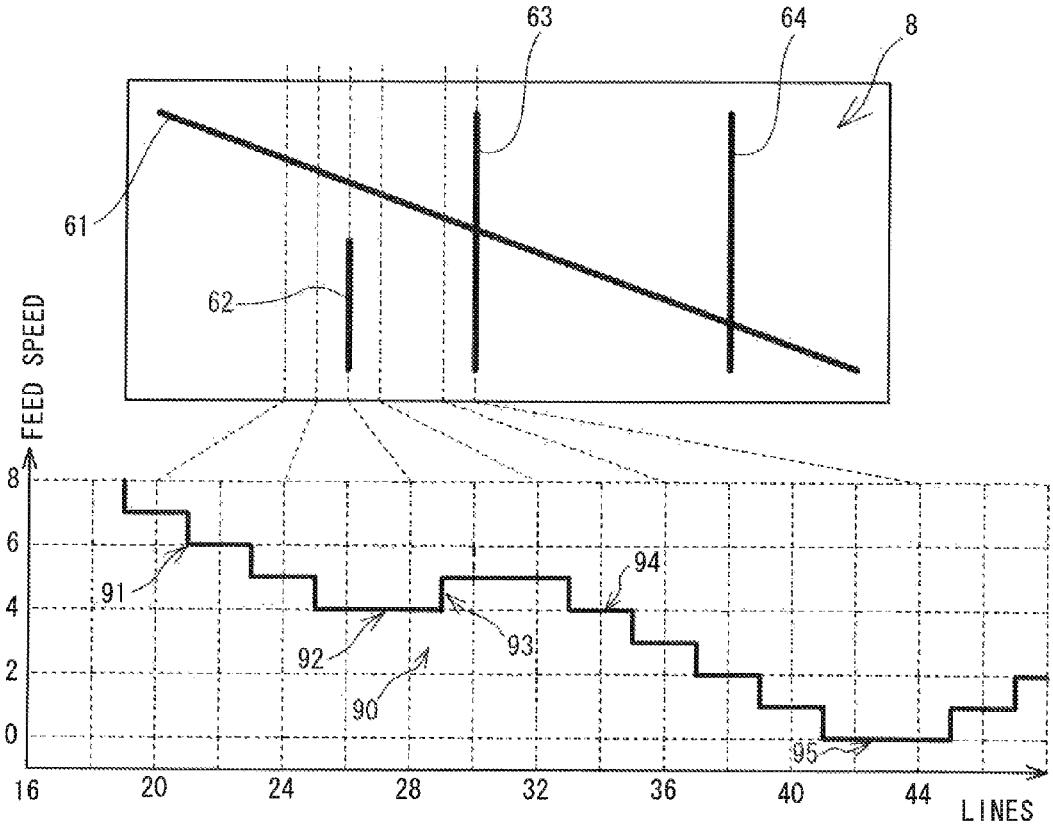
FIG. 22 is a figure that shows transitions in the feed speeds in the other embodiment.

The method by which the CPU 11 controls the feed speed based on the third table 121 in FIG. 21 will be explained in specific terms with reference to FIG. 22. Because a second speed of 8 is associated with the block (17, 18), so the CPU 11 transmits the control pulses for setting the feed speed to 8 to the drive motor 18 at the times when the printing of the 17th and 18th lines are performed, respectively. Because a second speed of 7 is associated with the block (19, 20), the CPU 11 transmits the control pulses to the drive motor 18 at the times when the printing of the 19th and 20th lines are performed, respectively. The CPU 11 repeats the processing that is described above based on the third table 121.

In a case where the CPU 11 controls the feed speed as described above, the feed speed decreases from 8 to 4 from the 19th line to the 25th line (the descending step-like segment 91 in the line graph 90). The feed speed is maintained at 4 from the 25th line to the 29th line (the horizontal line segment 92 in the line graph 90). Therefore, at the point when the 28th line is printed, the CPU 11 can feed the heat-sensitive tape 8 at the feed speed of 4, at which the line segment 62 can be printed on the heat-sensitive tape 8 appropriately. The feed speed decreases from 5 to 0 from the 33rd line to the 41st line (the descending step-like segment 94). The feed speed is maintained at 0 from the 41st line to the 45th line (the horizontal line segment 95 in the line graph 90). Therefore, at the point when the 44th line is printed, the CPU 11 can feed the heat-sensitive tape 8 at the feed speed of 0, at which the line segment 63 can be printed on the heat-sensitive tape 8 appropriately. By increasing the feed speed from 4 to 5 at the 29th line (the ascending step-like segment 93 in the line graph 90), the CPU 11 can shorten the time that is required in order to complete the printing on the heat-sensitive tape 8.

Figure 23:
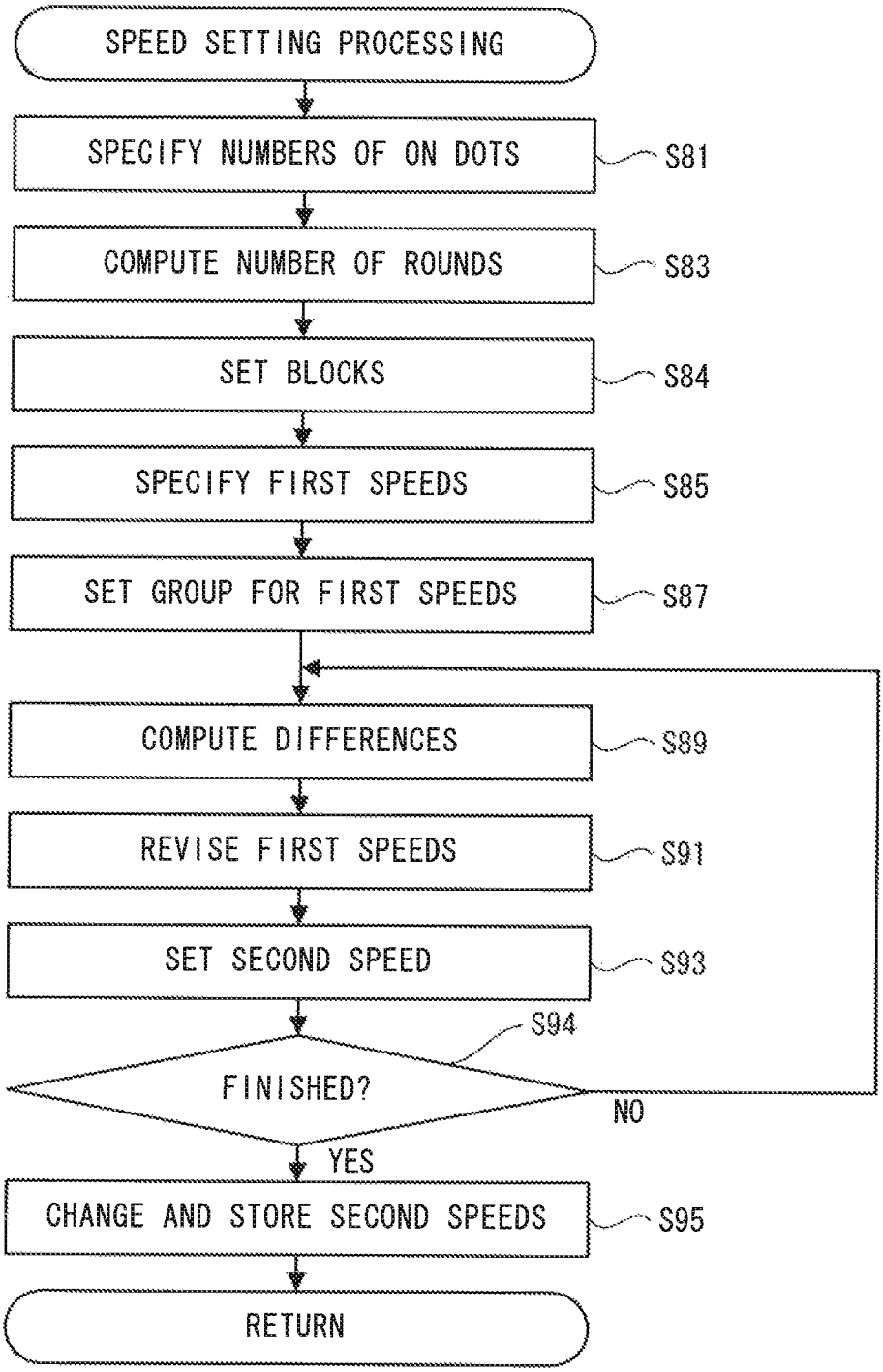
FIG. 23 is a flowchart of speed setting processing of the other embodiment.

The speed setting processing in a case where the control that has been described above is performed by the CPU 11 will be explained with reference to FIG. 23. Note that main processing of the present embodiment is the same with the main processing of the previous embodiment that is shown in FIG. 16.

The CPU 11 specifies the numbers of the ON dots for all of the lines (Step S81). The CPU 11 computes the number of rounds of operation for each line based on the specified numbers of ON dots (Step S83). The CPU 11 sets blocks by dividing the plurality of lines into a plurality of pairs of lines (S84). Based on the numbers of rounds of operation that have been computed at Step S83, the CPU 11 sets the feed speed for each line. The CPU 11 specifies the slower one of the feed speeds for the two lines in each block as the first speed that corresponds to the block. The CPU 11 sequentially specifies the first speeds for all of the blocks (Step S85).

The CPU 11 sets groups for the first speeds, each of the groups including the first speeds for ten blocks, starting from each one of the blocks as the start block (Step S87) (refer to FIG. 18). The CPU 11 selects one of the set groups as the object of the processing and computes the number of blocks (the difference) between the start block and each one of the blocks in the group (Step S89). The CPU 11 revises the first speed for each block by applying the difference that was computed at Step S89 to the first table 131 (refer to FIG. 5) (Step S91) (refer to FIG. 19). The CPU 11 sets the lowest value among the revised first speeds as the second speed (Step S93) (refer to FIG. 20). The CPU 11 determines whether a second speed has been set for every one of the groups that were set at Step S87 (Step S94). In a case where a group remains for which the second speed has not been set (NO at Step S94), the CPU 11, in order to set the second speed for the remaining group, returns to the processing at Step S89. The CPU 11 then defines the next unprocessed group as the object of the processing, and performs the processing at Steps S89 to S93. In a case where the CPU 11 has set the second speed for every one of the groups (YES at Step S94), the CPU 11 uses the second table 132 (refer to FIG. 9) to change, as necessary, the second speed for the start block of each group (Step S95). The CPU 11 stores the second speeds that have been changed as necessary in the third table 121 in association with the identifying information for the corresponding blocks (Step S95) (refer to FIG. 21).

As shown in FIG. 16, after the speed setting processing (Step S51) has finished, the CPU 11 sets the control pulse based on the second speed that is stored in the third table 121. The CPU 11 transmits the control pulse to the drive motor 18 (Step S53) at the times when the two lines in the block that corresponds to the second speed are printed, respectively (Step S53). At the same time, the CPU 11 performs the printing of one line on the heat-sensitive tape 8 by operating the thermal line head 112 (Step S55).

Note that the embodiments that are described above are only examples, and various types of modifications can be made. The printing medium is not limited to the heat-sensitive tape 8, and the printing medium may also be a heat-sensitive paper or the like. The flash ROM 13 may store a table in which the numbers of ON dots and the first speeds are associated. The CPU 11 may then specify the first speeds that correspond to the numbers of ON dots by referencing the table.

In the embodiments that are described above, the CPU 11 specifies the first speeds and the second speeds after the CPU11 has specified the numbers of ON dots for all of the lines at a time. In contrast, the CPU 11 may also specify the numbers of ON dots for a group of ten lines or of ten blocks at the time when the line that corresponds to the left end of one of the horizontal bars 50 in the bar graph 72 in FIG. 4 or of the horizontal bars 80 in the bar graph 75 in FIG. 18 is printed by the thermal line head 112. In other words, the CPU 11 may specify the numbers of ON dots for one group repeatedly with each iteration of the cycle T as the CPU 11 shifts the start line or the start block one line or one block at a time. The CPU 11 may specify the first speeds and the second speeds based on the specified numbers of ON dots, and may then print each line while feeding the heat-sensitive tape 8 at the second speed. The CPU 11 can thus specify the minimum numbers of ON dots that are required to set the second speed when printing is performed. Accordingly, the CPU 11 can efficiently specify the numbers of ON dots.

In the embodiments that are described above, after the CPU 11 revises the first speeds using the first table 131 (refer to FIG. 5), the CPU 11 sets the slowest first speed in each group as the second speed for the start line or the start block of that group. The CPU 11 further changes the second speeds as necessary using the second table 132 (refer to FIG. 9). As described previously, the first table 131 defines a relationship by which the speed revision increases by one level as the number of lines between the start line and another line increases by one, or as the number of blocks between the start block and another block increases by one, based on the rate of change in the feed speed when the drive motor 18 changes the feed speed. Therefore, in a case where the second speed for a certain line or a certain block is greater than the second speed for the line or the block to be printed next, that is, in a case where the printer 1 reduces the feed speed, the CPU 11 adjusts the difference between the two second speeds to 1 by applying the first table 131. Therefore, in a case where the printer 1 reduces the feed speed, the CPU 11 may set, as the ultimate second speeds, the second speeds that have been set for the respective start lines or the start blocks of a plurality of groups using the first table 131.

The embodiments that are described above are examples in which the second speeds are set based on the speeds that are derived by adding the speed revisions to the first speeds, using the first table 131 that is shown in FIG. 5. However, the second speeds need not be set based on the first speeds that have been revised by this method. For example, a function that expresses the relationships among the first speed for the specified line, the second speed for the start line, and the number of lines between the specified line and the start line may be determined in advance based on the rate of change in the feed speed when the drive motor 18 changes the feed speed, and may be stored in advance in the flash ROM 13, for example. In that case, the CPU 11 can determine the second speeds for the start line by plugging values for the first speed for the specified line and the number of lines between the specified line and the start line into the function. Further, for example, a function that expresses the relationships among the first speed for the specified block, the second speed for the start block, and the number of blocks between the specified block and the start block may be stored in advance in the flash ROM 13, for example. In that case, the CPU 11 can determine the second speed for the start block by plugging values for the first speed for the specified block and the number of blocks between the specified block and the start block into the function.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A printer, comprising:

a feeding portion configured to feed a printing medium in an auxiliary scanning direction, the feeding portion being capable to change a feed speed for the printing medium at a specified rate of change;

a printing portion comprising a plurality of heating elements arrayed in a main scanning direction, the main scanning direction being orthogonal to the auxiliary scanning direction, the plurality of heating elements being configured to perform printing of one line at a time on the printing medium fed in the auxiliary scanning direction by the feeding portion, the one line extending in the main scanning direction;

a processor configured to:

specify numbers of ON dots for at least a first specified block and a second specified block among a plurality of lines that make up a printed pattern, the first specified block being one of a plurality of blocks, each of the plurality of blocks including a first specified number of lines, the second specified block being another of the plurality of blocks and including a line to be printed before the first specified block, and the number of ON dots being a number of heating elements, among the plurality of heating elements, to be operated when the printing of one line is performed;

specify first speeds that respectively correspond to at least the first specified block and the second specified block based on the numbers of ON dots;

set a second speed based on the first speeds that respectively correspond to the first specified block and the second specified block, such that the printing medium is fed by the feeding portion at the first speed for the first specified block when the printing of the first specified block is performed by the printing portion, the second speed being a feed speed of the printing medium fed by the feeding portion when the printing of the second specified block is performed by the printing portion, the second speed being set such that the printing of the first specified block is performed on the printing medium fed at the first speed immediately after the feeding portion has changed the feed speed from the second speed to the first speed in accordance with the specified rate of change; and control the feeding portion and the printing portion such that the printing medium is fed by the feeding portion at the second speed when the printing of the second specified block is performed by the printing portion, and such that the feed speed is adjusted to the first speed just one line before a specified line is printed.

2. The printer according to claim 1, wherein the processor is configured to:

specify a speed revision based on a number of blocks between the first specified block and the second specified block, a value of the speed revision increasing as the number of blocks increases; and set the second speed for the second specified block based on a speed that is derived by adding the specified speed revision to the first speed for the first specified block.

3. The printer according to claim 2, wherein the processor is configured to:

specify the numbers of ON dots for a plurality of lines included in each one of a plurality of groups when printing of a start block is performed by the printing portion, each one of the plurality of groups including a second specified number of blocks among the plurality of blocks, the start block being a block to be printed first among the second specified number of blocks in each one of the plurality of groups, specify the first speeds that respectively correspond to the second specified number of blocks for which the numbers of ON dots have been specified, sequentially define, as the first specified block, each one of the second specified number of blocks for which the numbers of ON dots have been specified, define the start block as the second specified block, and add the speed revision to the first speed for the first specified block; and set, for each one of the plurality of groups, the second speed for the second specified block based on a lowest first speed among the first speeds to which the speed revisions have been added.

4. The printer according to claim 2, wherein the processor is configured to:

specify the numbers of ON dots for all of the plurality of lines, specify the first speeds that respectively correspond to all of the plurality of blocks, set a plurality of groups, each of the plurality of groups including a second specified number of blocks among the plurality of blocks, and each of the plurality of blocks being a first block in one of the plurality of groups;

sequentially define, as the first specified block, each one of the second specified number of blocks included in each one of the plurality of groups, define a start block as the second specified block, and add the speed revision to the first speed for the first specified block, the start block being a block to be printed first among the second specified number of blocks in each one of the plurality of groups; and set, for each one of the plurality of groups, the second speed for the second specified block based on a lowest first speed among the first speeds to which the speed revisions have been added.

5. The printer according to claim 1, wherein the first specified number is one.

6. The printer according to claim 1, wherein the specified rate of change is proportional to difference that indicates a number of lines between the first specified block and the second specified block.

7. A non-transitory computer-readable medium storing computer-readable instructions that, when executed by a processor of a printer, cause the printer to perform the steps of:

specifying numbers of ON dots for at least a first specified block and a second specified block among a plurality of lines that make up a printed pattern, the first specified block being one of a plurality of blocks, each of the plurality of blocks including a first specified number of lines, the second specified block being another of the plurality of blocks and including a line to be printed before the first specified block, and the number of ON dots being a number of heating elements, among a plurality of heating elements of the printer, to be operated when the printing of one line is performed;

specifying first speeds that respectively correspond to at least the first specified block and the second specified block based on the numbers of ON dots;

setting a second speed based on the first speeds that respectively correspond to the first specified block and the second specified block, such that a printing medium is fed by a feeding portion at the first speed for the first specified block when the printing of the first specified block is performed by a printing portion, the second speed being a feed speed of the printing medium fed by the feeding portion when the printing of the second specified block is performed by the printing portion, the setting of the second speed being such that the printing of the first specified block is performed on the printing medium fed at the first speed immediately after the feeding portion has changed the feed speed from the second speed to the first speed in accordance with a specified rate of change the feeding portion being configured to feed the printing medium in an auxiliary scanning direction and being able to change the feed speed for the printing medium at the specified rate of change, the printing portion comprising the plurality of heating elements arrayed in a main scanning direction and configured to perform printing of one line at a time on the printing medium fed in the auxiliary scanning direction by the feeding portion, the one line extending in the main scanning direction, and the main scanning direction being orthogonal to the auxiliary scanning direction; and controlling the feeding portion and the printing portion such that the printing medium is fed by the feeding portion at the second speed when the printing of the second specified block is performed by the printing portion, and such that the feed speed is adjusted to the first speed just one line before a specified line is printed.

8. The non-transitory computer-readable medium according to claim 7, wherein the setting of the second speed includes:

specifying a speed revision based on a number of blocks between the first specified block and the second specified block, a value of the speed revision increasing as the number of blocks increases; and setting the second speed for the second specified block based on a speed that is derived by adding the specified speed revision to the first speed for the first specified block.

9. The non-transitory computer-readable medium according to claim 8, wherein the specifying of the numbers ON dots includes specifying the numbers of ON dots for a plurality of lines included in each one of a plurality of groups when printing of a start block is performed by the printing portion, each one of the plurality of groups including a second specified number of blocks among the plurality of blocks, the start block being a block to be printed first among the second specified number of blocks in each one of the plurality of groups, the specifying of the first speeds includes specifying the first speeds that respectively correspond to the second specified number of blocks for which the numbers of ON dots have been specified, and the setting of the second speed includes:

sequentially defining, as the first specified block, each one of the second specified number of blocks for which the numbers of ON dots have been specified, defining the start block as the second specified block, and adding the speed revision to the first speed for the first specified block; and setting, for each one of the plurality of groups, the second speed for the second specified block based on a lowest first speed among the first speeds to which the speed revisions have been added.

10. The non-transitory computer-readable medium according to claim 8, wherein the specifying of the numbers of ON dots includes specifying the numbers of ON dots for all of the plurality of lines, specifying of the first speeds includes specifying the first speeds that respectively correspond to all of the plurality of blocks, setting of the second speed includes:

setting a plurality of groups, each of the plurality of groups including a second specified number of blocks among the plurality of blocks, and each of the plurality of blocks being a first block in one of the plurality of groups;

sequentially defining, as the first specified block, each one of the second specified number of blocks included in each one of the plurality of groups, defining a start block as the second specified block, and adding the speed revision to the first speed for the first specified block, the start block being a block to be printed first among the second specified number of blocks in each one of the plurality of groups; and setting, for each one of the plurality of groups, the second speed for the second specified block based on a lowest first speed among the first speeds to which the speed revisions have been added.

11. The non-transitory computer-readable medium according to claim 7, wherein the first specified number is one.

12. The non-transitory computer-readable medium according to claim 7, wherein the specified rate of change is proportional to difference that indicates a number of lines between the first specified block and the second specified block.

* * * * *